United States Patent [19]

Palmer

[11] 4,064,674

[45] Dec. 27, 1977

[54] DISC RECORD MANUFACTURING METHOD AND APPARATUS

[75] Inventor: Leonard Palmer, Morristown, N.J.

[73] Assignee: Lened, Inc., Elizabeth, N.J.

[21] Appl. No.: 642,974

[22] Filed: Dec. 22, 1975

[51] Int. Cl.[2] ..... B65B 55/04

[52] U.S. Cl. ..... 53/23; 53/35; 53/123; 53/190; 425/810

[58] Field of Search ..... 53/188, 190, 123, 187, 53/189, 35, 23, 212, 254, 384; 425/116, 810; 271/269; 264/107; 198/406

[56] References Cited

U.S. PATENT DOCUMENTS

| | | | |
|---|---|---|---|
| 2,535,853 | 12/1950 | Hermani | 271/269 X |
| 3,208,194 | 9/1965 | Johnson et al. | 53/190 |
| 3,663,136 | 5/1972 | Westermann | 425/116 |
| 3,665,674 | 5/1972 | Bivans et al. | 53/159 X |
| 3,702,749 | 11/1972 | Flusfeder | 425/810 |
| 3,833,328 | 9/1974 | Palmer et al. | 425/116 X |

FOREIGN PATENT DOCUMENTS

| | | | |
|---|---|---|---|
| 1,269,170 | 4/1972 | United Kingdom | 425/810 |

*Primary Examiner*—Harrison L. Hinson
*Assistant Examiner*—John Sipos
*Attorney, Agent, or Firm*—Blum, Moscovitz, Friedman & Kaplan

[57] ABSTRACT

A disc record manufacturing method and apparatus wherein a record pressed at a press station is transported to a trimming station where flash is trimmed from the record with the trimmed record then being transported beyond the trimming station. While the record is maintained in a horizontal attitude during the pressing and trimming operations, when transported beyond the trimming station the record is pushed along guides which guide the record in such a way that it changes from its horizontal attitude to a substantially upright attitude in which the record is permitted to fall downwardly. An envelope is held with an open upper end thereof situated in the path of downward falling movement of the record so as to receive the latter, and then the envelope with the record therein is released to drop to a stacking guide where the envelope with the record therein remains in an upright attitude while a horizontal stack is formed from a series of envelopes with records therein. The trimmed record is guided by a pair of guide bars which are curved in such a way that when the record is pushed to the curved portion of the guide bars the record tilts from its horizontal to its upright attitude and is then free to fall downwardly along the guide bars into the open end of a waiting envelope.

19 Claims, 19 Drawing Figures

DISC RECORD MANUFACTURING METHOD AND APPARATUS

BACKGROUND OF THE INVENTION

The present invention relates to disc records and in particular to methods and apparatus for manufacturing disc records.

At the present time methods and apparatus for manufacturing disc records are highly developed. For examples of the present state of the art reference may be made to U.S. Pat. Nos. 3,702,749 and 3,833,328. The methods and apparatus disclosed in these patents are entirely satisfactory. However, it is desirable to improve the presently known methods and apparatus for manufacturing disc records.

SUMMARY OF THE INVENTION

It is accordingly a primary object of the present invention to provide disc record manufacturing methods and apparatus which are simpler and less costly than previously known methods and apparatus so as to achieve greater outputs at lesser costs.

Moreover, it is an object of the present invention to provide apparatus which not only is simple but which is also exceedingly compact so that the apparatus will occupy less floor space than has heretofore been required.

According to the method of the invention after a record has been pressed from a cake and the flash trimmed therefrom, the record is guided first while in a horizontal attitude and then is permitted to tilt into a substantially upright attitude while falling freely, and an envelope with an upper open end is situated in the path of falling movement of the record.

The apparatus of the invention includes guides for guiding a record first horizontally with the record in a horizontal attitude and then downwardly along a curved path from which the record is permitted to freely fall into the upper open end of a waiting envelope. The guides take the form of simple curved bars having grooves which receive opposed edge regions of the record, and the record is simply pushed by a suitable push pin along the first part of these guides until the record has tilted sufficiently into an upright attitude to be capable of falling freely into the waiting envelope.

BRIEF DESCRIPTION OF DRAWINGS

The invention is illustrated by way of example in the accompanying drawings which form part of this application and in which:

FIG. 5 is a fragmentary plan view of that part of the structure which has an envelope supply means as well as a stacking arrangement, the structure which is shown in FIG. 15 being situated beneath the structure which is illustrated in FIG. 10, and it will be noted that both of these structures are shown at a smaller scale in FIG. 2;

DESCRIPTION OF PREFERRED EMBODIMENTS

Figure 1:
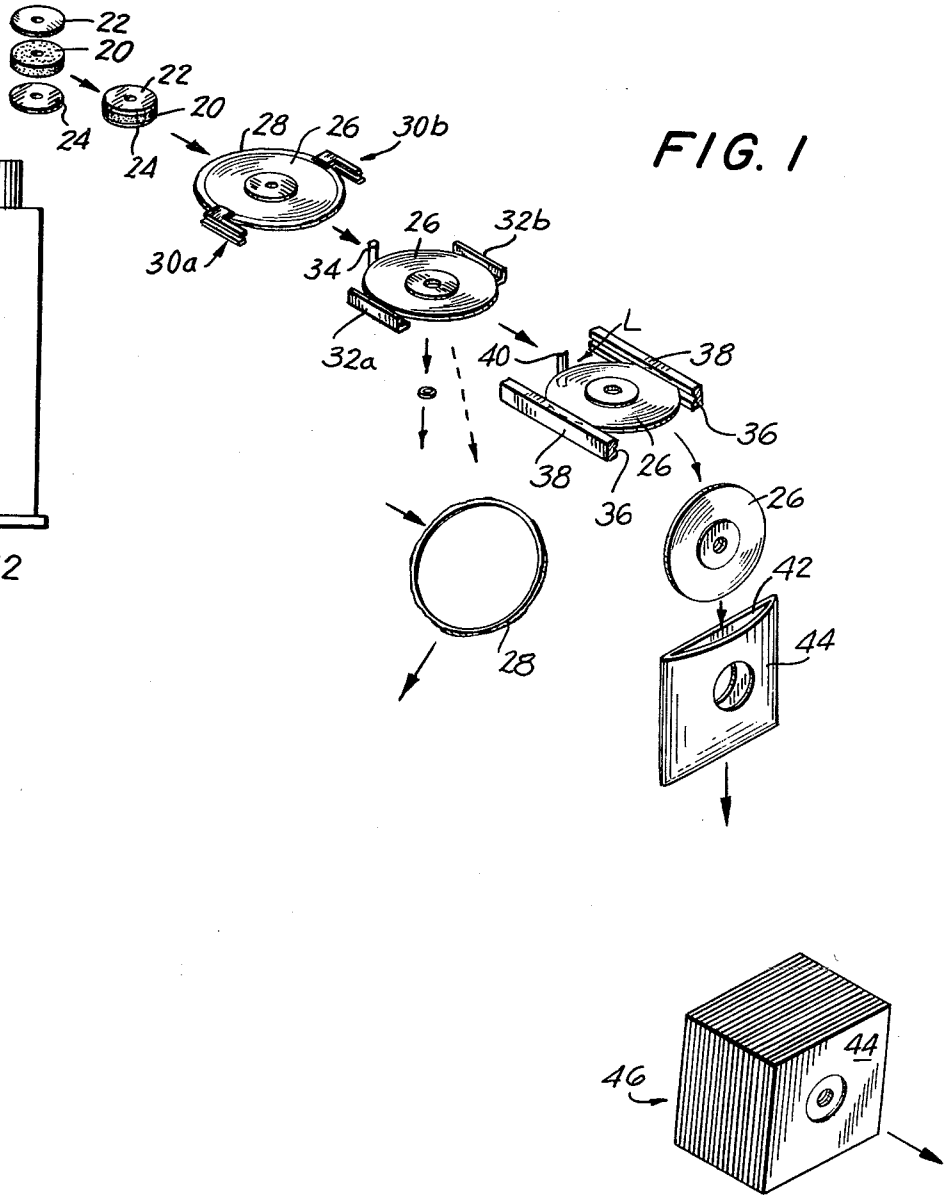
FIG. 1 is a diagrammatic illustration of the method of the present invention as performed by the apparatus of the present invention.

A general schematic illustration of some of the operations performed according to the method and apparatus of the present invention is provided in FIG. 1. FIG. 1 shows at the upper left a cake 20 from which a record is to be pressed. This cake 20 is derived from an extruder which extrudes a sufficient amount of plastic into a mold in which the cake is shaped. Supply means are provided for supplying upper and lower labels 22 and 24 so that they are positioned respectively above and below the cake 20 as illustrated in FIG. 1. With the cake and labels in this relative position with respect to each other, they are transported to the press station where they come together and are pressed between a pair of dies so as to form in this way a record 26 having flash 28 at the periphery thereof. Gripper fingers **30*a* and 30*b* engage the record 26 at the flash 28 thereof and form part of transporting means which transports the record 26** from the press station to a trimming station where the flash is trimmed therefrom so as to provide the record 26 without flash. The flash 26 is removed from the trimming station and disposed of in the manner shown schematically in FIG. 1 and described in greater detail below. At the trimming station the record 26 with the flash trimmed therefrom rests on a pair of ledges 32*a* and 32*b*, in the manner shown schematically in FIG. 1, and these ledges together with a push pin 34 also form part of the transporting means, this part of the transporting means serving to transport the trimmed record from the trimming station up to a predetermined location situated beyond the trimming station. The record 26 is shown at this predetermined location beyond the trimming station with opposed edge regions of the record 26 situated in V-grooves 36 of a pair of stationary guide bars 38 which form a guide means for guiding the record for movement. This movement beyond the predetermined location shown in FIG. 1 is brought about by a second push pin 40, and the guide means 38 guides the record 26 for further horizontal movement and then for tilting movement into a substantially upright attitude in which the record falls freely into the upper open end 42 of an envelope 44 held in the position shown in FIG. 1 by a suitable holding means of the invention as described below. From the position shown in FIG. 1 where the envelope 44 receives the record 26, the envelope 44 is free to fall so as to form part of a horizontal stack 46 of envelopes 44 with records 26 therein, this stack being horizontal and being moved to the right, as shown at the lower part of FIG. 1, along a suitable magazine.

PRESS STATION

Figure 4:
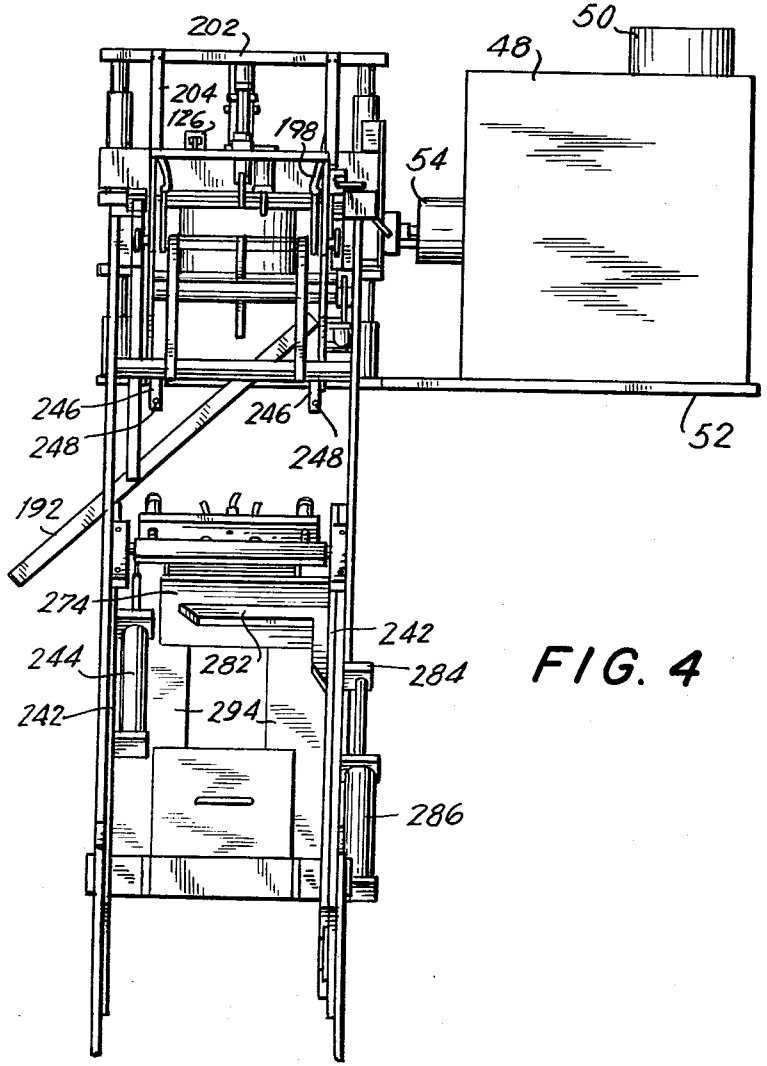
FIG. 4 is an end elevation of the apparatus as seen from the right of FIGS. 2 and 3.
Figure 2:
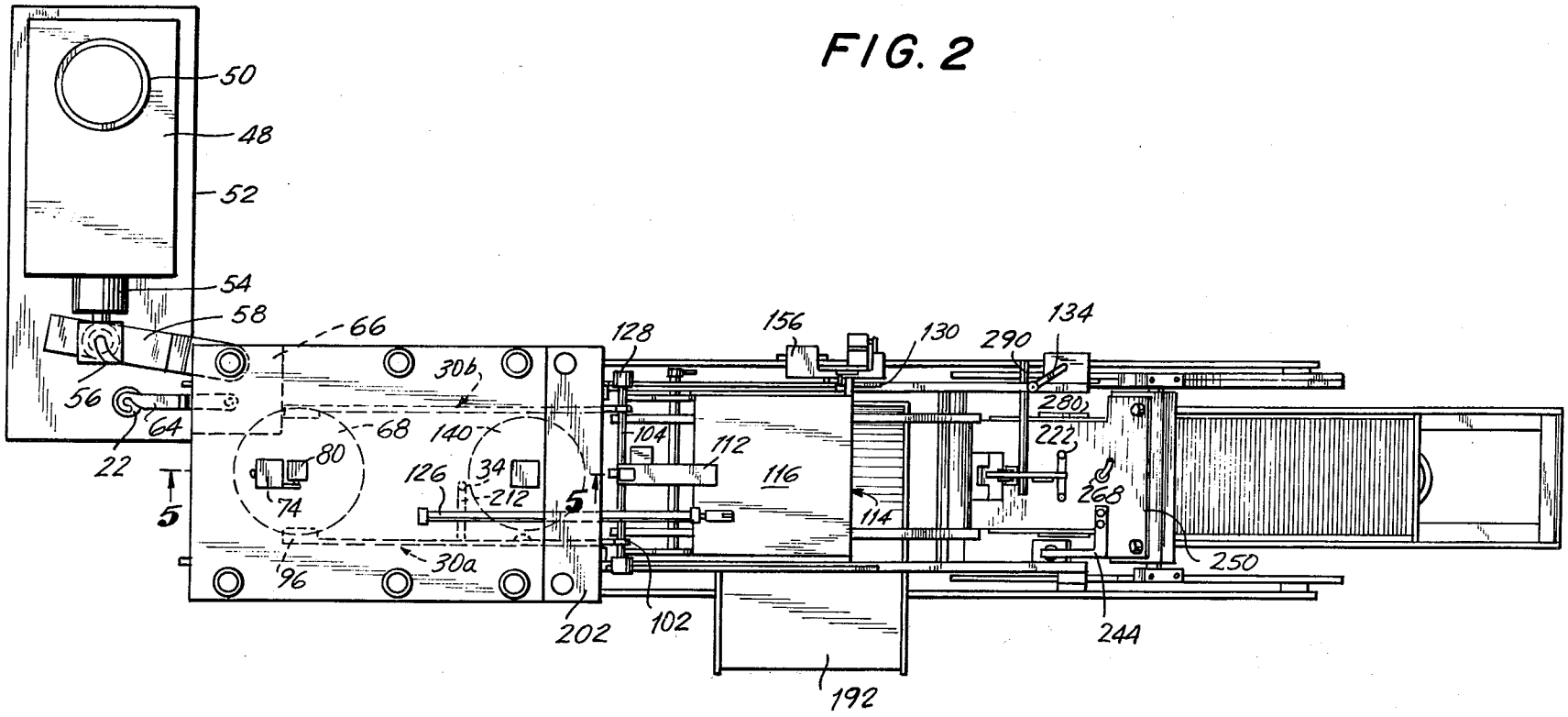
FIG. 2 is a top plan view of the apparatus.
Figure 3:
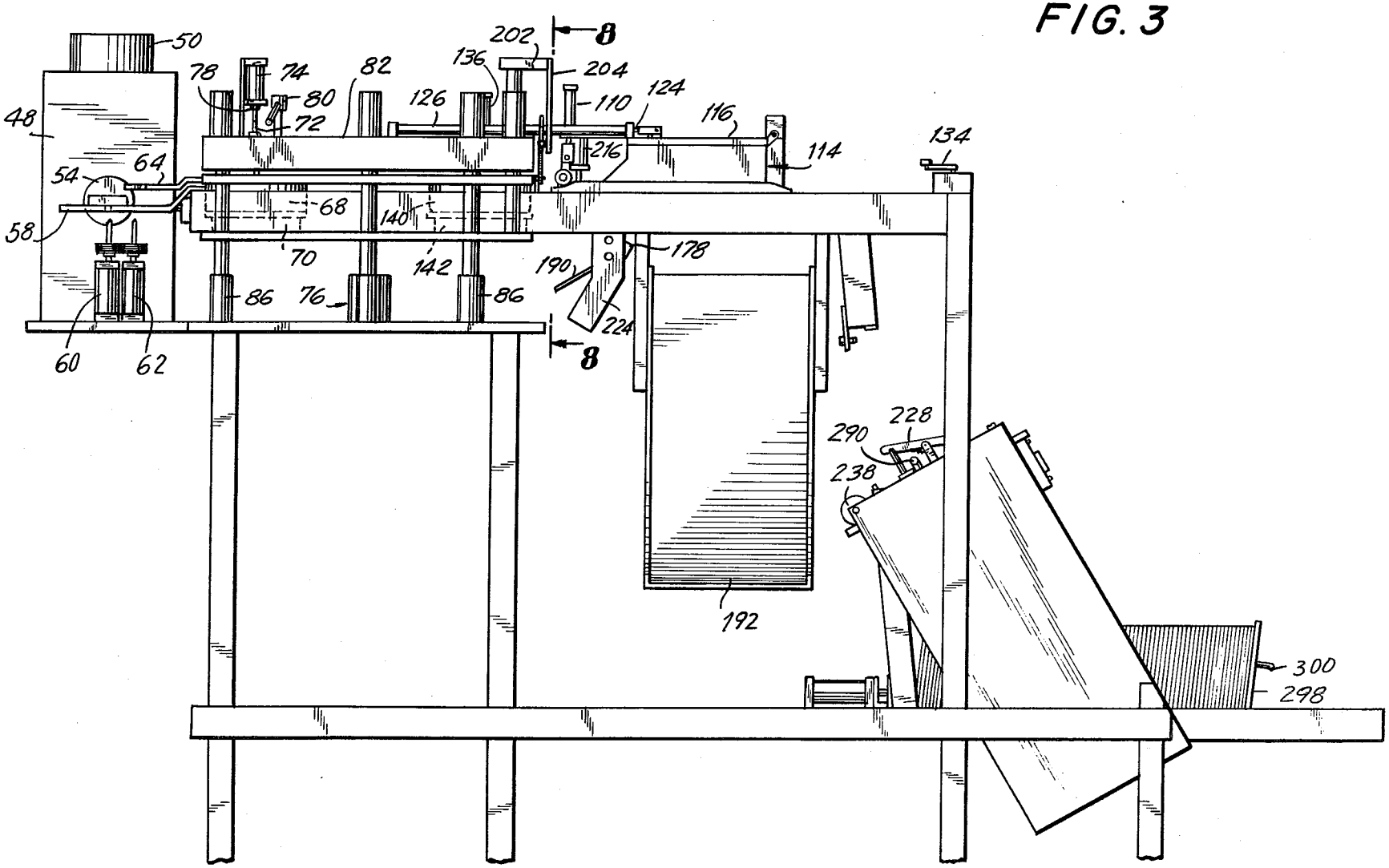
FIG. 3 is a side elevation of the apparatus.
Figure 5:
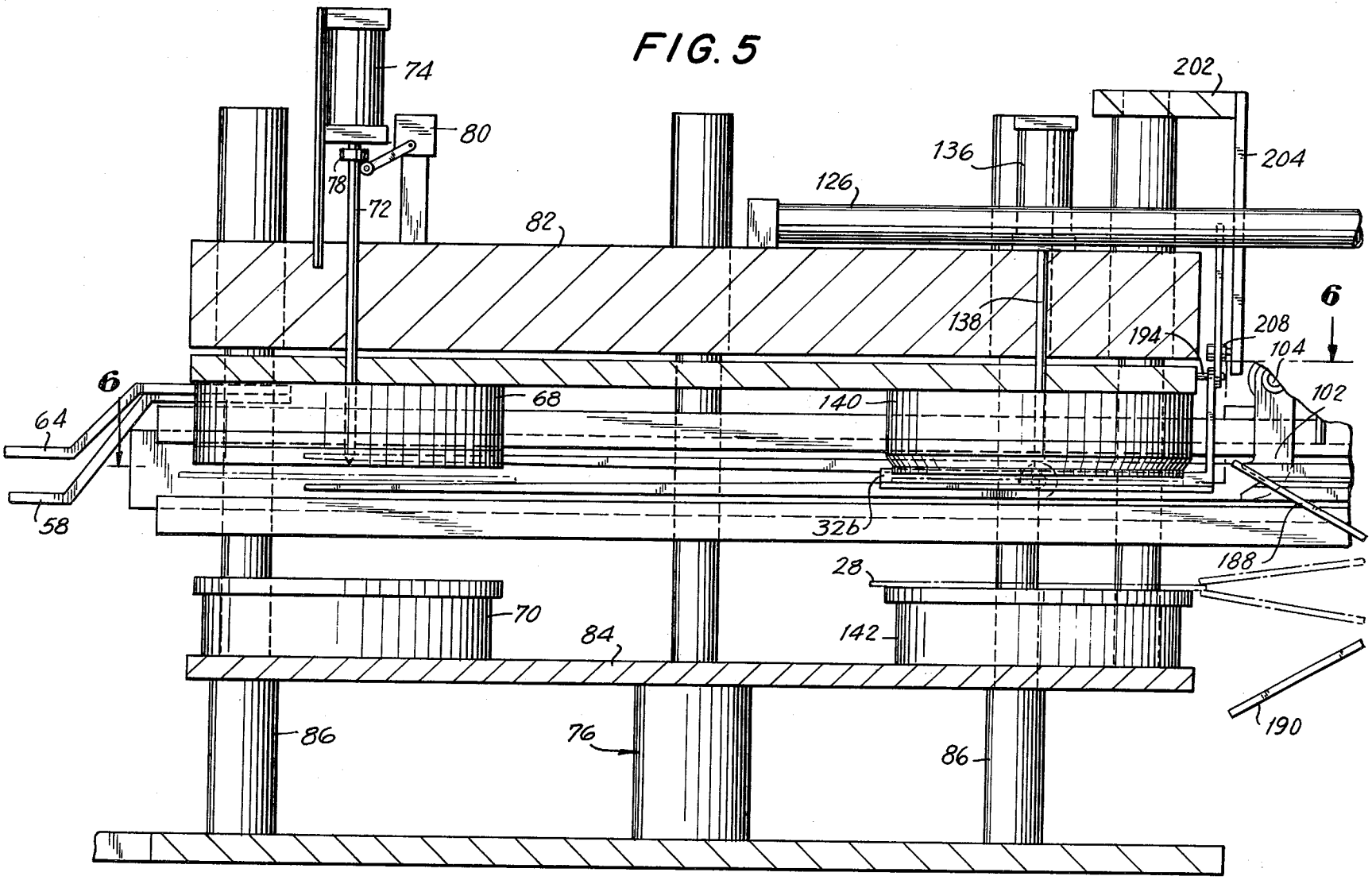
FIG. 5 is a longitudinal sectional elevation of the press and trimming stations, taken along line 5—5 of FIG. 2 in the direction of the arrows and showing the structure at a scale which is enlarged as compared to FIG. 2.

As is shown at the left end regions of FIGS. 2 and 3 and the upper right portion of FIG. 4, an extruder means 48 is provided for extruding the cake 20 from a suitable plastic material. This material is supplied to the extruder 48 by way of a hopper 50 thereof. The extruder is supported on any suitable support 52. The extruder 48 has an outlet 54 through which a predetermined amount of the extruded material is delivered into a mold 56 (FIG. 2) which situates the molded cake on a swingable arm 58. The lower part of the arm 58 has a suitable section structure for holding by suction at the lower part of the arm 58 the lower label 24 which is derived from the label supply means 60 which is shown schematically at the left of FIG. 3. A label supply means 62 is provided for supplying the upper label 22. Each upper label is delivered in a known way to a suction structure situated at the lower surface of an upper swingable arm 64. The swingable arms 58 and 64 are controlled in a manner which does not form part of the present invention by way of a unit 66 indicated schematically in FIG. 2 in such a way that the arms 58 and 64 swing in a counterclockwise direction from the position shown in FIG. 2, which is their rest positions, to a position situated between upper and lower press dies 68 and 70 which are indicated at the left of FIG. 5. The arms 58 and 64 are swung into such position that the cake and labels are coaxially situated along a common vertical axis which coincides with the axis of a centering pin 72 actuated by way of a pneumatic assembly 74 as is indicated in FIG. 5. With the cake and labels thus positioned so that they are coaxial with the pin 72, the latter is lowered to pass through the upper label, the cake, and the lower label, and then the arms 58 and 64 are returned to the position shown in FIG. 2. For this purpose the arms 58 and 64 are provided with slots which at their inner ends receive the pin 72 and which are curved so as to permit the arms 58 and 64 to return to the rest position shown in FIG. 2 while the cake and labels are retained by the pin 72 which extends through the coaxial openings of the cakes and labels. When the arms 58 and 64 return to their starting positions, the cake and labels retained by the pin 72 will be free to fall down along the latter, but they will be retained by the lower die 70 which is formed with a central opening which receives the lower portion of the pin 72 when the latter has been lowered, and then during the pressing operation a suitable hydraulic fluid is supplied to a ram 76 which raises the lower die 70 up to the upper die 68 so as to press the record while adhering the labels to the opposed faces thereof. The upper die 68 remains stationary while the lower die 70 moves up and down with respect to the upper die 68 as a result of the action of the ram 76. The centering pin 72 carries a collar 78 which during vertical movement of the pin 72 actuates a switch 80 for a purpose described below. The switch 80 is carried by the upper stationary wall 82 of the frame structure which fixedly carries the upper pressing die 68 at the pressing station shown at the left of FIG. 5. The ram structure 76 has an upper portion 84 which carries the die 70 and which is guided by suitable vertically extending guide bars 86.

As has been indicated above in connection with FIG. 1, when the cake is pressed into the record 26, a flash 28 is formed at the periphery thereof, and this flash 28 projects outwardly beyond the dies 68 and 70.

Figure 6:
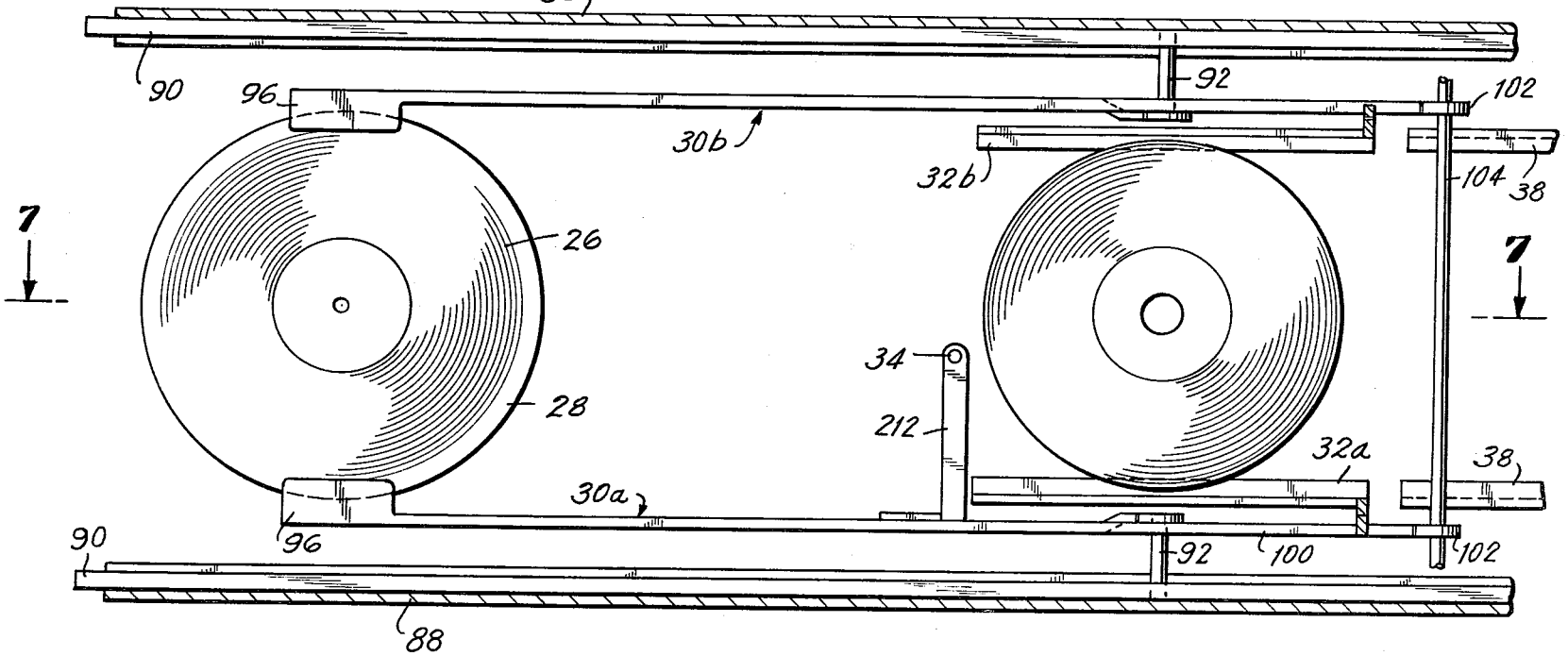
FIG. 6 is a partly sectional plan view taken along line 6—6 of FIGS. 5 in the direction of the arrows and showing further details of the press and trimming stations.
Figure 7:
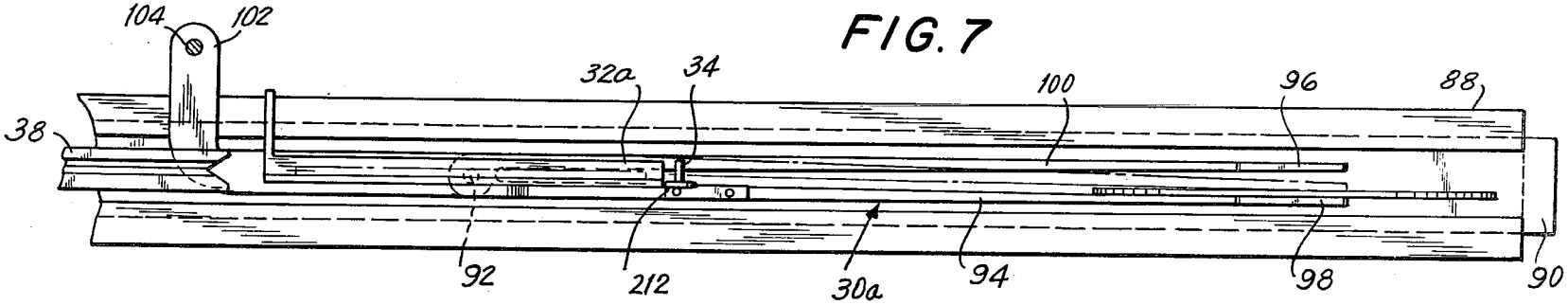
FIG. 7 is a partly sectional longitudinal elevation of the structure of FIG. 6 taken along line 7—7 of FIG. 6 in the direction of the arrows.

The frame structure which carries the upper support 82 and the lower movable table 84 at the press station also carries a pair of horizontally extending guides 88 which receive in their interior a pair of slide rails 90 which are horizontal and parallel to each other, situated at the same elevation, and these slide rails form part of a transporting means which serves to transport the record through the several stages of the apparatus and method of the invention. The gripping fingers 30*a* and 30*b* are shown in FIG. 6 situated inwardly of the slide rails 90. These slide rails 90 fixedly carry coaxial stationary horizontal pins 92 and these pins 92 fixedly carry the lower gripping fingers 94 of the pair of gripping finger assemblies 30*a* and 30*b*. At their left free ends, as viewed in FIG. 6, the gripping fingers have tabs between which the flash 28 becomes located. Thus, FIG. 7 shows for the gripping finger assembly 30*a* the upper and lower tabs 96 and 98, and of course similar tabs are provided at the assembly 30*b* as is apparent from FIG. 6. Thus, the lower gripping fingers 94 will remain stationary with respect to the slide bars 90. The upper gripping fingers 100 which terminate in the tabs 96 are swingable on the pins 92. These upper fingers 100 extend beyond the pins 92 and terminate in upwardly directed free ends 102 which are located in the manner shown in FIG. 6. A transverse rod 104 extends between as well as through and beyond the upper end regions of the upwardly extending portions 102 of the swingable fingers 100.

The weight of the substantially L-shaped portions of the fingers 100 situated beyond the fingers 94 as well as the weight of the transverse rod 104 and the structure attached thereto is such that normally the fingers 100 will be in a position where their ends which carry the tabs 96 are spaced upwardly from the tabs 98, and the elevation of the spaced tabs 96 and 98 of the pair of finger assemblies 30*a* and 30*b* is such that the flash issuing from between the pressing dies will be received in the space between the pair of lower tabs 98 and upper tabs 96. Of course, at the start of the pressing operations the slide rails 90 have already been shifted toward the left, as viewed in FIG. 6, so that the tabs at the left ends of the fingers, as viewed in FIG. 6, are situated at opposite sides of the centering pin 72 in readiness to receive the flash issuing beyond the dies at the periphery of the pressed record. Between the upwardly extending finger portions 102, the rod 104 passes through the lower end of a link 106 shown most clearly at the left of FIG. 11. This link 106 is pivotally connected at its top end to the lower end of a piston rod 108 which is connected to a piston slidable in a cylinder 110 carried by a plate 112 which is fixed to a carriage 114. The carriage 114 has a top wall 116 fixed to and carrying the elongated bar or plate 112 which projects forwardly from the top wall 116. As is shown most clearly in FIG. 14, the top wall 116 of the carriage 114 is carried by a pair of vertical side walls 118 of the carriage 114. These side walls 118 extend downwardly past and beyond the slide rails 90. By way of suitable spacer blocks 120, the side walls 118 of the carriage 114 are fixed to the slide rails 90 so that these slide rails must move together with the carriage 114.

Figure 11:
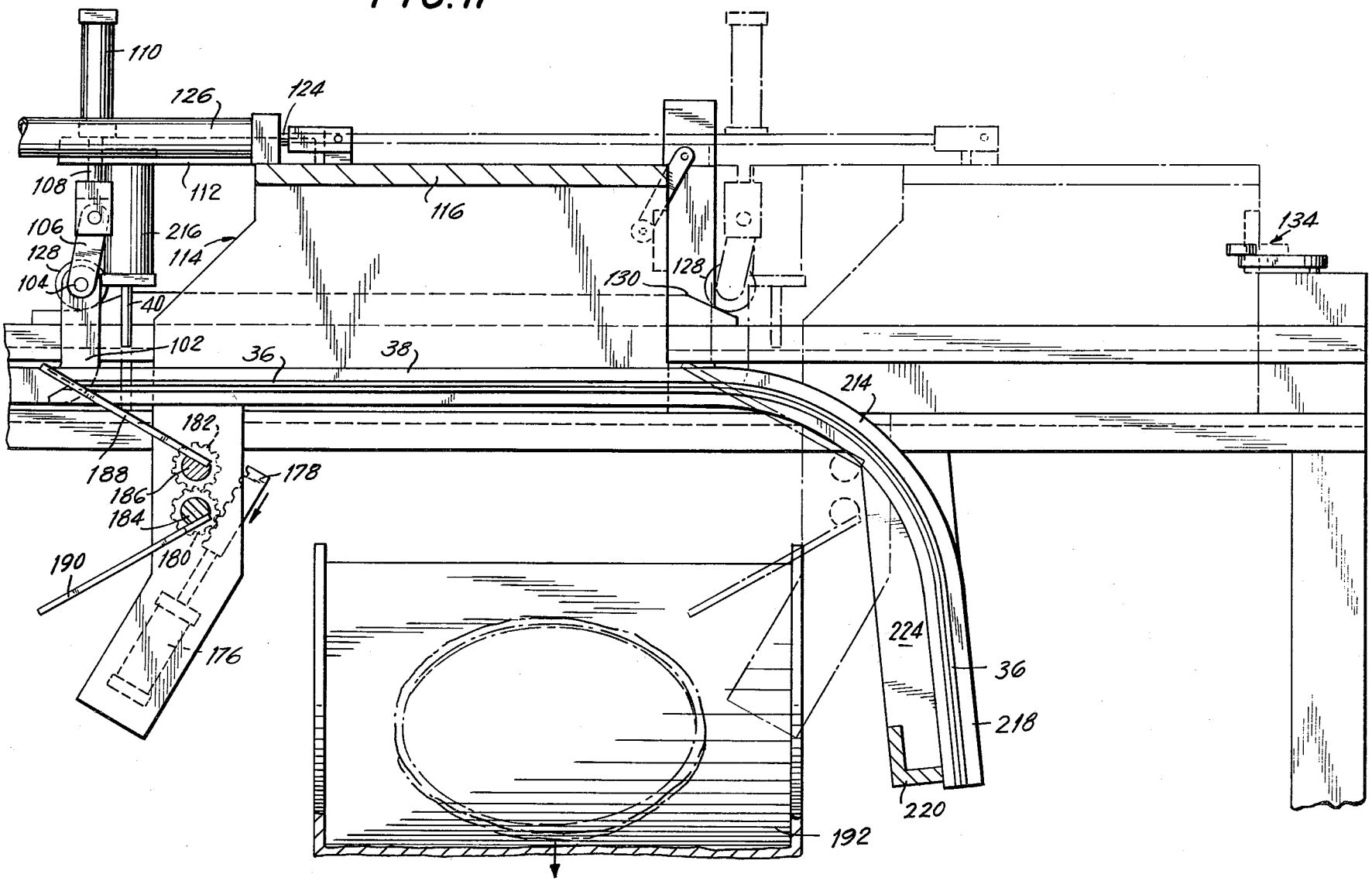
FIG. 11 is a partly sectional elevation taken along line 11—11 of FIG. 10 in the direction of the arrows and showing further details of the structure situated beyond the trimming station.

The top wall 116 of the carriage 114 fixedly carries an upwardly extending arm 122 which is pivoted at its upper end to a piston rod 124 fixed to a piston which slides in a cylinder 126 illustrated fragmentarily at the upper left of FIG. 11. The cylinder 126 is fixed at its left end, as viewed in FIGS. 2 and 5, to the stationary frame or support plate 82 which carries the upper pressing die 68 as described above.

At the end of a pressing operation, the ram 76 lowers the table 84 and the lower pressing die 70 and at the same time the unit 74 raises the rod 72. Of course the lowering of the lower pressing die 70 permits the pressed record to drop onto the lower tabs 98 of the fingers 94 which are fixed through the pins 92 to the slide rails 90, the upper tabs 96 still being spaced above the flash which engages the tabs 98 to support the record on the fingers 94. When the centering pin 72 has been elevated almost up to the position shown in FIG. 5, the collar 78 thereof actuates the switch 80, and through the latter a control signal is provided to actuate the unit 110 which receives at the underside of the piston rod 100 and thus raise the link 106 and the bar 104, thus swinging the upper tabs 96 into engagement with the flash in order to grip the latter between the upper tabs 96 and the lower tabs 98. At the same time, the actuation of the switch 80 serves to supply fluid under pressure to the left side of the piston which is in the cylinder 126, as viewed in FIG. 5, so that the piston in the cylinder 126 is now advanced to the right, thus causing the carriage 114 to start its stroke traveling toward the right as viewed in FIGS. 2 and 11. As is apparent from FIG. 10, the rod 104 carries outwardly beyond the upwardly extending end portions 102 of the swingable fingers 100 a pair of freely turnable rollers 128. In the starting position of the carriage 114 shown in FIG. 11 the rollers 128 are situated just to the left of and slightly beyond a pair of elongated horizonatlly extending cams 130 mounted on and extending along the upper surfaces of the guides 88 for the slide rails 90. Thus, in response to actuation of the switch 80 by the upwardly moving collar 78 of the pin 72, the swingable gripper fingers are swung to grip the flash and at the same time the carriage 114 starts moving toward the right as viewed in FIG. 11, and the impulse given by way of the unit 110 is only of a short duration but long enough to enable the rollers 128 to reach the upper surfaces of the cams 130 so that through cooperation of the rollers 128 and the cams 130 the swingable fingers 100 are maintained in the position where the tabs 96 thereof press the flash of the record against the lower tabs 98 while the carriage 114 continues to move to the right, as viewed in FIG. 11, in response to the supply of fluid under pressure into the cylinder 126. Thus, the record which has been pressed at the pressing station where the pressing dies 68 and 70 are located is now transported toward the trimming station, the movement of the carriage 114 acting through its connection to the slide rails 90 to shift the latter in the guide 88 and thus transport the gripping fingers together with the record away from the press station.

While the pressing operations were going forward, a new cake was formed and the labels were positioned thereto, and when the press record is transported in the above manner away from the press station the arms 58 and 64 again swing with the cake and labels positioned with respect to each other as described above into the space between the pressing dies. This initiation of the swinging of the arms 58 and 64 to place the cake and labels between the pressing dies is also initiated by actuation of the switch 80 when the pin 72 moves upwardly toward the postion shown in FIG. 5. For details in connection with the molding of the cake and the positioning of the labels with respect thereto, reference may be made to U.S. Pat. No. 3,702,749. Thus, while one record is being transported away from the press station, the cake and labels to be used in connection with the next record are positioned between the pressing dies.

TRIMMING STATION

As has been indicated above, the initial gripping of the flash results from actuation of the swingable gripping fingers from the unit 110, and then the continued gripping is achieved by the action of the rollers 128 on the horizontally extending cams 130. Fluid is supplied to the cylinder 126 until the carriage 114 is shifted to the dot-dash line position shown in FIG. 11. The right wall 118 of the carriage 114, as viewed in FIG. 14, fixedly carries a plate 132 which projects laterally in the manner shown in FIG. 14. In the path of movement of this plate 132 is a switch 134 and when the plate 132 engages the switch 134 to actuate the latter, a signal is provided to terminate the stroke of the carriage and all of the parts connected therewith, so that the transporting stroke away from the press station terminates when the carriage reaches the dot-dash line position shown in FIG. 11. At this time the rollers 128 have just moved beyond the cams 130 so that the ends of the swingable fingers which carry the rollers 128 can swing downwardly thus displacing the upper tabs 96 upwardly from the flash so that the record now only rests on the lower tabs 98.

The actuation of the switch 80 near the end of the upward travel of the pin 72 at the press station also actuates a time delay which delays the next downward movement of the centering pin 72 for a predetermined number of seconds such as for a period of 5 or 6 seconds which is sufficient for the arms 58 and 64 with the tabs and labels to move into the space between the open press dies 68 and 70, whereupon the pin 72 automatically starts to move downwardly through the coaxial apertures of the labels and cake as described above. Thus, when the switch 134 is actuated by the plate 132 the centering pin 72 of the press station has already moved through the apertures of the labels and cake. The switch 134 also serves to actuate a pneumatic unit 136 which now operates to move a centering pin 138 at the trimming station down through the central opening of the previously pressed record which has arrived at the trimming station when the switch 134 is actuated. The trimming station includes an upper trimming die 140 which is fixed to the same plate 82 as the upper pressing die 68. Also the trimming station includes a lower trimming die 142 which is carried by the same plate 84 as the lower pressing die 70. Thus, the lower pressing and trimming dies 70 and 142 are displaced together in response to operation of the ram 76. The actuation of the switch 134 to terminate the stroke of the carriage 114 also serves to initiate a time delay which after an interval of only 1 or 2 seconds starts the return movement of the carriage 114 by reversing the flow of pressure fluid in the cylinder 126. This time delay is sufficient for the pin 138 at the trimming station to move through the central opening of the record, so that when the carriage returns to its initial position the previously pressed record is retained by the pin 138 at the trimming station. The pin 138 extends downwardly beyond the opening of the record through a distance sufficient to permit the record to fall while being retained by the pin 138, the record falling after the lower tabs of the gripping fingers return toward their starting position.

Figure 10:
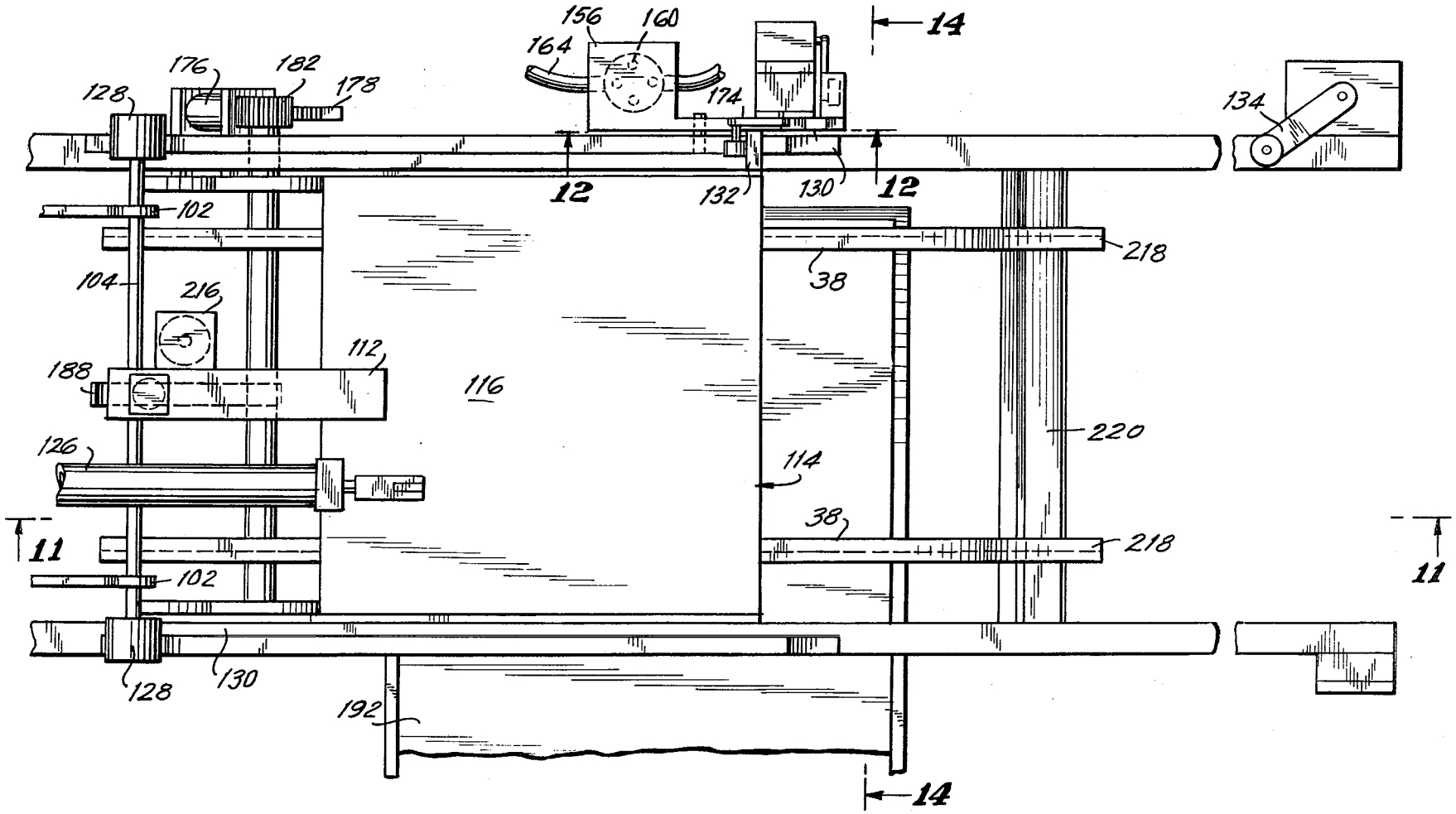
FIG. 10 is a fragmentary plan view of part of the structure which is situated beyond the trimming station, FIG. 10 illustrating this structure at a scale larger than FIG. 2.
Figure 12:
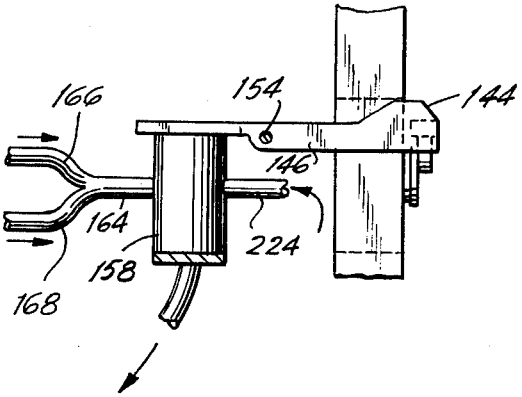
FIG. 12 is a fragmentary partly sectional elevation taken along line 12—12 of FIG. 10 in the direction of the arrows and showing part of the vacuum-controlling structure.
Figure 13:
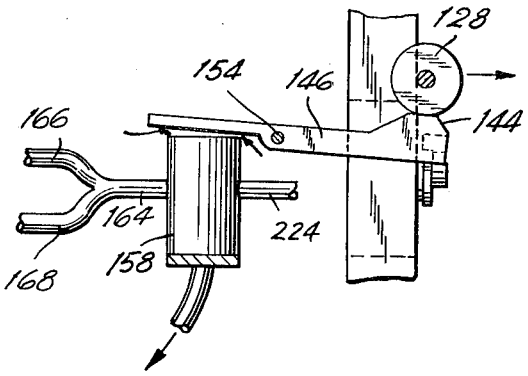
FIG. 13 shows the structure of FIG. 12 in a position where the vacuum has been released.
Figure 19:
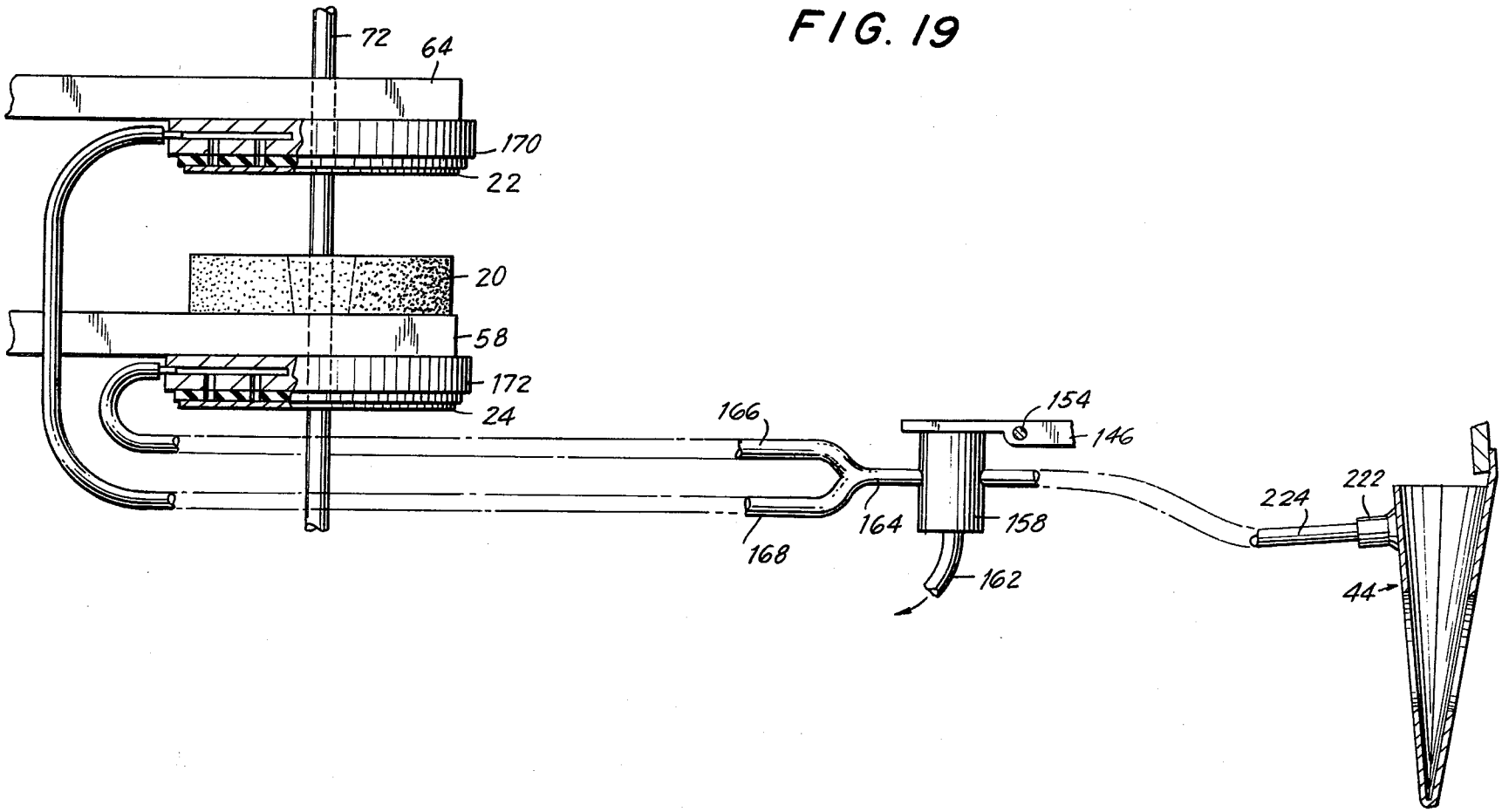
FIG. 19 is a schematic illustration of part of the structure controlled by the vacuum controls shown in FIGS. 12 and 13.

As is apparent from FIGS. 10, 12, and 13, when the plate 132 actuates the switch 134, one of the rollers 128 has not only moved just beyond the cam 130 but in addition it engages a camming portion 144 of a swingable lever 146 so as to swing the lever 146 from the position of FIG. 12 to the position of FIG. 13. At the same time, a lateral extension 148 of the lever 146 actuates a switch 150 shown most clearly in FIG. 14. A supporting structure 152 for the switch 150 is carried by the right guide 88 of FIG. 14, and this supporting structure 152 carries the pivot pin 154 which supports the lever 146. The lever 146 normally remains in the position shown in FIG. 12 where a substantially square portion 156 thereof (FIG. 10) rests against and covers the top end of a container 158 which has at its top wall a plate formed with openings 160. As is schematically indicated in FIG. 19, the container 158 communicates through a pipe 162 with any suitable source of suction such as with a suction pump. Normally, the openings 160 are closed by the portion 156 of the lever 146. However, when the lever 146 is swung to the position shown in FIG. 13, the switch 150 interrupts the operation of the motor which drives the suction pump, and at the same time air can enter into the container 158 through the openings 160, as shown by the arrows in FIG. 13. A tube 164 communicates with and extends from the container 158. As is shown in FIG. 19, the tube 164 has branches 166 and 168 respectively communicating with the suction units 170 and 172 carried by the lower portions of the arms 64 and 58 which are fragmentarily illustrated in FIG. 19 with the cake 20 resting on the arm 58 while the centering pin 72 at the press station extends through the labels 22 and 24 as well as the cake 20. Thus, the actuation of the switch 150 and the uncovering of the openings 160 releases the suction at the units 170 and 172 so that the labels 20 and 24 are released to be capable of falling freely along the centering pin 72. At the same time the actuation of the switch 150 transmits a signal to the unit 66 for swinging the arms 58 and 64 back to the position thereof shown in FIG. 2, so that only the cake 20 and the labels 22 and 24 are retained by the pin 72. The structure of the suction units 170 and 172 is shown in U.S. Pat. No. 3,702,749.

Thus, the slide rails 90 will return with the structure connected thereto back to the starting position and the lower press and trimming dies will remain in their lower position until the rails 90 have reached their starting position, the cake 20 and labels 22 and 24 are being retained by the pin 72 while the previously pressed record is retained at the trimming station by the pin 138 as described above. The supporting structure 152 which carries the switch 150 as well as the pivot pin for the lever 146 also carries a switch 174 situated in the path of movement of the plate 132. When the plate 132 reaches and actuates the switch 174, the return stroke of the carriage 114 is terminated as a result of a signal derived from the switch 174. At the same time the switch 174 provides a signal to supply fluid under pressure to the ram 76 which now raises the table 84 and the pressing and trimming dies 70 and 142, so that the trimming operation goes forward simultaneously with the pressing operation. The structure of the trimming dies and the manner in which they trim the record is not shown in detail inasmuch as these features are identical with the corresponding features shown in U.S. Pat. No. 3,529,322.

The ram 76 will thus displace the dies 70 and 142 first upwardly to bring about the pressing and trimming operations and then downwardly back to the position shown in FIG. 5, and the trimmed flash 28 will remain resting on the lower trimming die 142 in order to return downwardly therewith. At the same time in a manner which is not illustrated but which is shown in U.S. Pat. No. 3,529,322, a central portion of the record is punched at the trimming station. The central waste material which is punched from the center of the record is permitted to fall into a suitable receptacle which is not illustrated.

Figure 14:
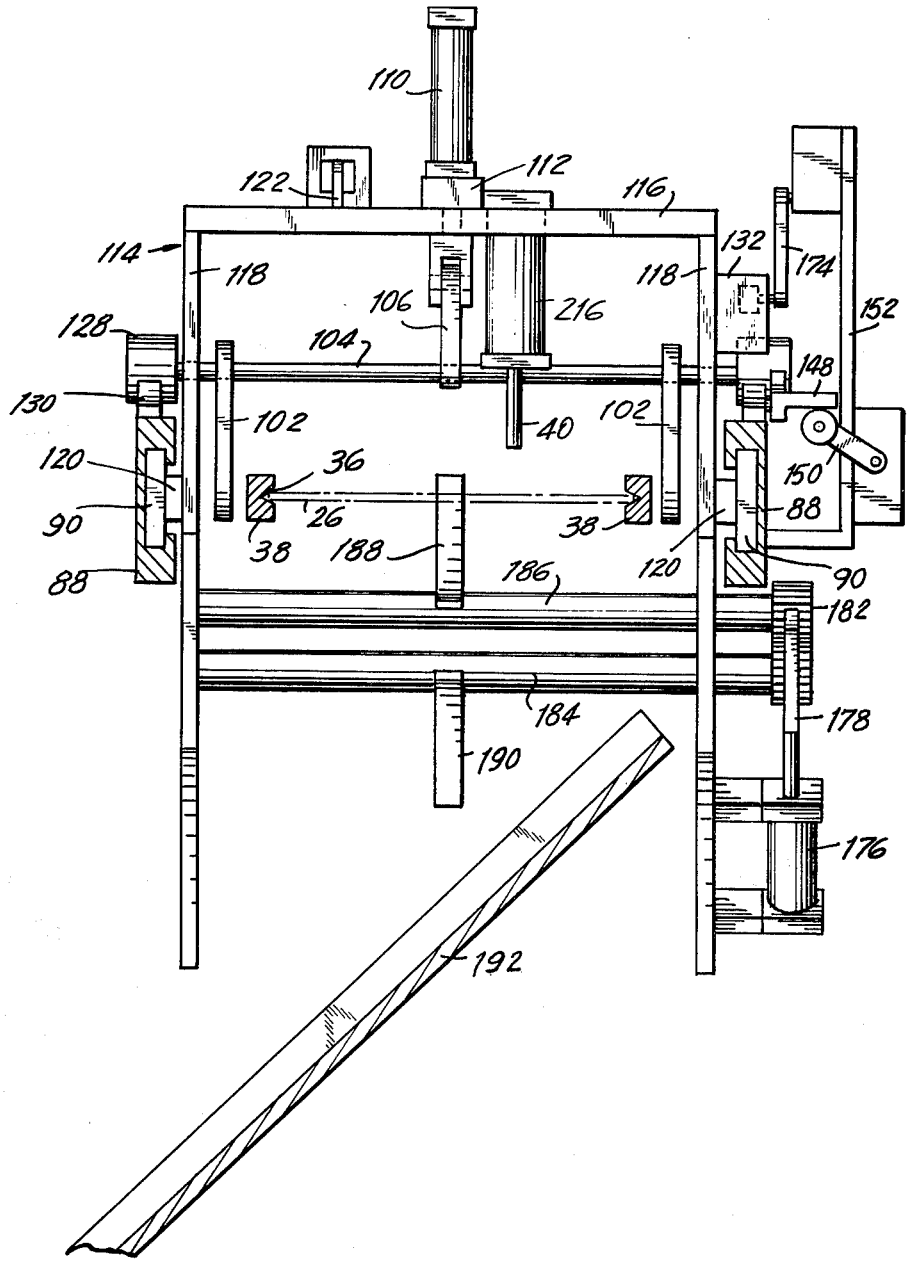
FIG. 14 is a partly sectional transverse elevation of the structure of FIG. 10 taken along line 14—14 of FIG. 10 in the direction of the arrows.

As is shown in FIG. 14, the right wall 118 of the carriage 114 carries at its outer face brackets which support a pneumatic unit 176. The piston of this unit carries a rack 178 which meshes with a rotary gear 180 which in turn meshes with a rotary gear 182. These gears are respectively fixed to transversely extending turnable rods 184 and 186, and the rods 184 and 186 respectively carry fingers 188 and 190, as shown most clearly in FIGS. 11 and 14. The actuation of the unit 176 in response to the return of the table 84 to its lower position will result in downward movement of the rack 178 so as to swing the free ends of the fingers 188 and 190 toward each other, and these free ends will grip the flash 28 in a manner indicated at the lower right portion of FIG. 5. Thus, the flash 28 will be held by the fingers 188 and 190 which remain in the dot-dash line grip position shown in FIG. 5 during the stroke of the transporting means toward the right to the dot-dash line position shown in FIG. 11, and when the switch 134 is actuated at the end of this stroke the fluid flow in the unit 176 is reversed to return the fingers 188 and 190 to their starting position. At this time the flash falls onto a downwardly inclined chute 192 to be received in a suitable receptacle and the fingers 188 and 190 now remain in their open position during the return stroke of the transporting means.

Figure 9:
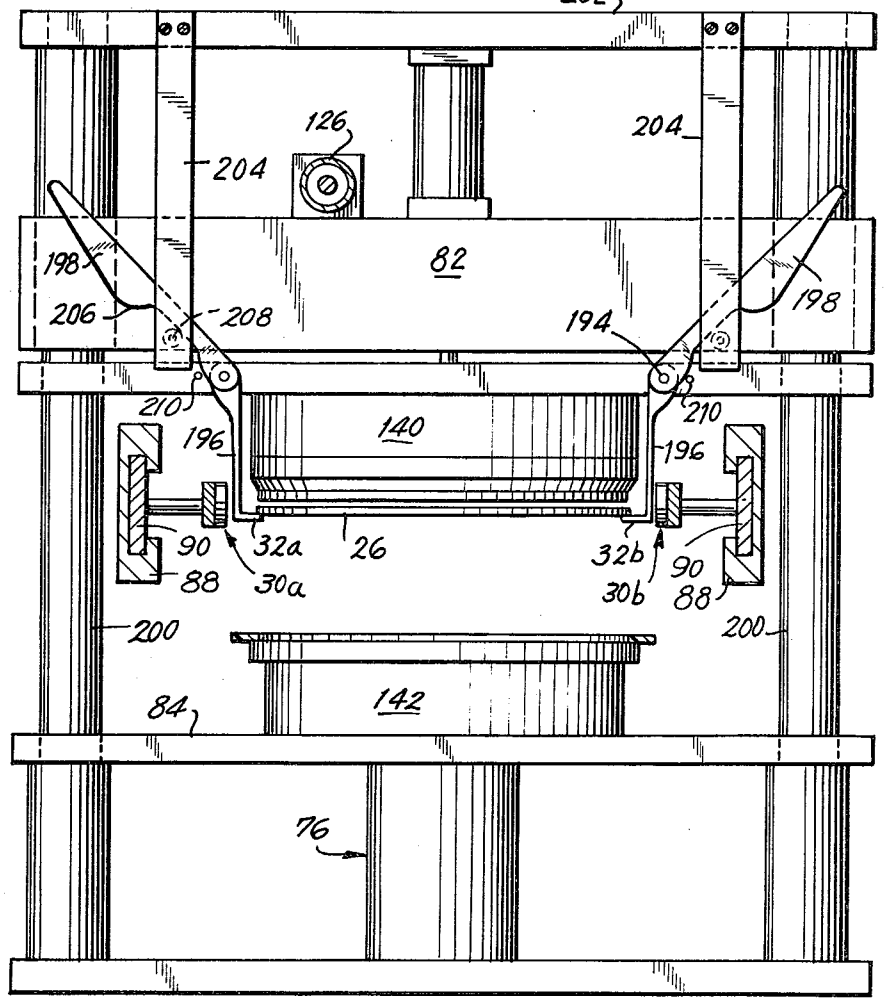
FIG. 9 shows the structure of FIG. 8 after the flash has been trimmed from the record and the lower trimming die has returned to its rest position.
Figure 8:
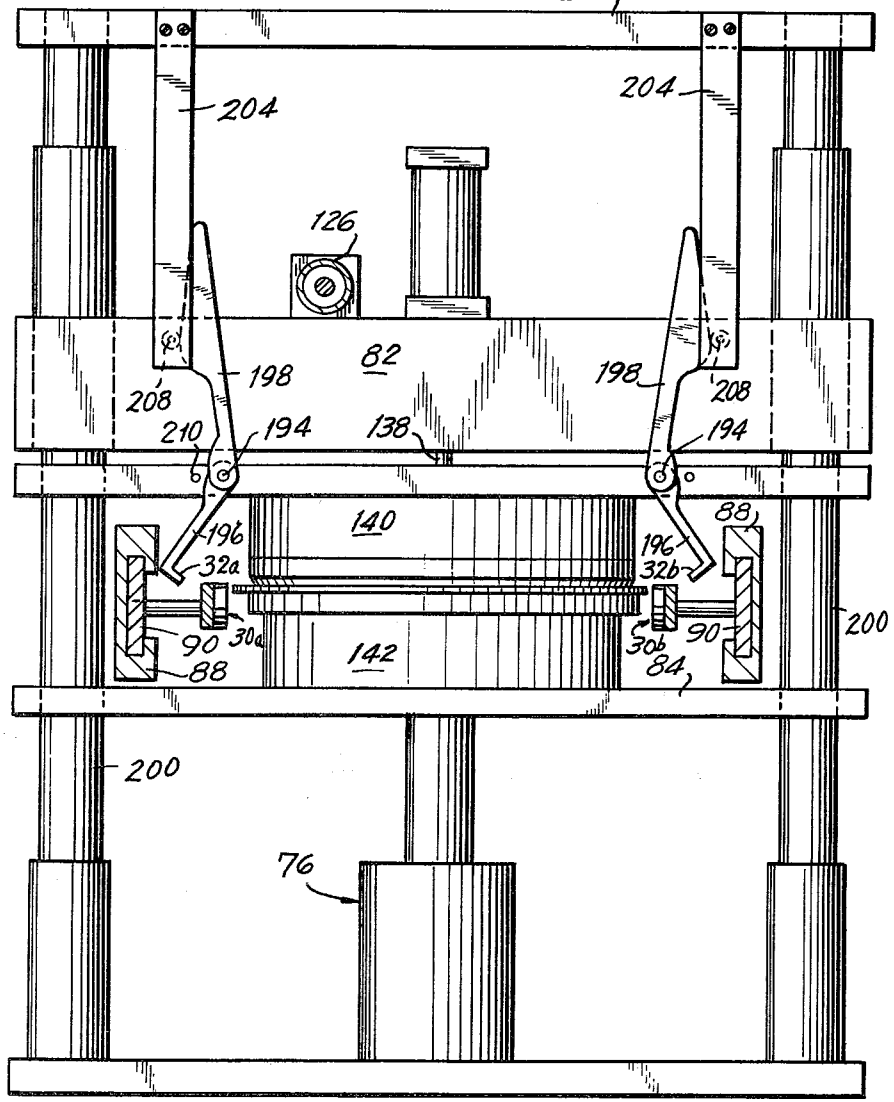
FIG. 8 is a partly sectional transverse elevation taken along line 8—8 of FIG. 3 in the direction of the arrows and showing the trimming station in a position where the trimming dies operate to trim flash from a previously pressed record.

The upper stationary table 82 which carries the upper stationary pressing die 68 and trimming die 140 carries at its right end, as viewed in FIG. 5, a pair of pivot pins 194, these pivot pins serving to support the upwardly directed arms 196 which are fixed to and extend upwardly from one end of a pair of horizontally extending ledges 32*a* and 32*b* which have been referred to above in connection with FIG. 1. These ledges are simply in the form of a pair of elongated angle irons which are capable of projecting at their lower horizontal walls beneath the upper trimming die 140 in the manner shown in FIG. 9.

The upwardly directed arms 196 are also fixed with a pair of wing members 198 which thus swing with the arms 196.

The table 84 is fixed to the lower ends of a pair of vertical posts 200 which are capable of moving vertically through suitable bores formed in the table 82 and which move up and down with the table 84. These posts 200 fixedly carry at their upper ends a transverse bar 202 which at its right edge, as viewed in FIG. 5, carries a pair of downwardly directed arms 204. Thus, the arms 204 will move up and down with the table 84. These arms carry at their lower ends rollers which engage the lower edges of the wings 198. These lower edges have curved portions 206 which when engaged by the rollers 208 carried by the arms 204 transmit a turning movement to the wings 198. Thus, during upward movement of the table 84 and thus of the arms 204, the rollers 208 will actuate the wings 198 so as to swing the ledges 32*a* and 32*b* outwardly away from each other, thus clearing the trimming dies during the trimming operations. However, when the table 84 returns to its lower position, the rollers 208 move downwardly beyond the wings 198 so that the weight of the wings 198 will return the ledges 32*a* and 32*b* to the positions shown in FIG. 9, this movement being limited by a pair of stop pins 210 fixed to the same surface of the plate 82 which carries the pivot pins 194. The cooperation of the rollers 208 with the lower edges 206 of the wings 198 is such that as soon as the lower trimming die 142 with the flash thereon has moved downwardly through a slight distance from the upper stationary trimming die 140, the ledges 32*a* and 32*b* have already been swung toward each other to be positioned beneath the record 26 which simply falls onto the ledges 32*a* and 32*b* so as to be supported thereby in the manner shown in FIG. 9.

These ledges 32*a* and 32*b* position the trimmed record 26 in a horizontal plane which is in alignment with a horizontal plane bisecting the V-grooves 36 of the stationary guide bars 38 which have been referred to above in connection with FIG. 1. The guide bars 38 are supported from beneath by the frame structure in such a way that they are situated between the gripping finger assemblies and between the side walls 118 of the carriage 114 as well as beneath the transverse rod 104, so that these guide bars while remaining stationary do not in any way interfere with the movable components.

As is shown most clearly in FIG. 11, the upper portions of the guide bars 38 are horizontal, and as was mentioned above, the plane which bisects the horizontal grooves 36 in the horizontal guide bar portion 38 coincides with the plane in which the ledges 32*a* and 32*b* situate the trimmed record 26.

As was referred to above in connection with FIG. 1, a push pin 34 serves to push the trimmed record 26 along the ledges 32*a* and 32*b*. The push pin 34 is shown most clearly in FIGS. 6 and 7. Thus it will be seen that the stationary finger 94 of the gripper assembly 38 fixedly carries a bracket 212 which has a horizontally extending upper arm projecting inwardly into the space between the assemblies 30*a* and 30*b* in the manner apparent from FIG. 6. The inner end of this upper arm of the bracket 212 fixedly carries the vertical push pin 34. Thus, during the movement of the carriage 114 to the right to transport a record from the press station to the trimming station, the push pin 34 will engage an edge of the record trimmed at the trim station simultaneously with pressing of a record at the press station, and this trimmed record will thus be advanced by the push pin 34 along the ledges 32*a* and 32*b* into the V-grooves 36 of the guide bars 38 of the guide means for the record 26. Thus, at the end of the transporting stroke when the switch 134 is actuated by the plate 132 carried by the carriage 114, the previously trimmed record will be situated in the grooves 36 of the guide bars 38 at the predetermined location L designated in FIG. 1, and this predetermined location L is situated at a horizontal portion of the guide bars 38 in advance of the right downwardly curved portions 214 thereof, one of which is shown for one of the bars 38 in FIG. 11.

It will be noted from FIG. 6 that the push pin 34 is situated nearer to the assembly 30*a* than the center of the trimmed record. This will enable the bracket 212 and the push pin 34 to clear the centering pin 138 of the trimming means during the return movement of the slide rails 90. As was indicated above, during the initial part of the return movement the tabs of the gripping fingers will return while the centering pin 138 holds the previously pressed record at the trimming station. The record thus held at the trimming station will fall downwardly along the centering pin 138 so as to become situated beneath the bracket 212 which passes over the record at the trimming station while the bracket 212 returns to the position shown in FIG. 6, and at the same time because of the illustrated location of the push pin 34 and the free end of the bracket 212, these components will clear the centering pin 138. Thus, through this arrangement a trimmed record is transported to the predetermined location L while the previously pressed record can be situated at the trimming station in preparation for the trimming operations and the bracket 212 and push pin 34 can return to the starting position.

PACKAGING AND STACKING

As was indicated above in connection with FIG. 1, a second push pin 40 pushes the record 26 further along the grooves 36 of the bars 38 beyond the predetermined location L. As was indicated in FIG. 11, the second push pin 40 is in the form of an armature of a solenoid 214 which is fixedly carried by the arm or bar 112 which is fixed to and projects from the upper wall 116 of the carriage 114. When the carriage 114 moves to the dot-dash line position shown in FIG. 11 to actuate the switch 134, the actuation of the latter also serves to energize the solenoid 214 so as to retract to the push pin 40 upwardly. This solenoid 214 remains energized until the transport means returns to its starting position determined by engagement of the switch 174 by the plate 132 as described above. The actuation of the switch 174 not only terminates the return stroke of the transport means but also deenergizes the solenoid 214 so that the push pin 40 returns to its lower position extending across the plane occupied by the record and bisecting the grooves 36. Thus, because the pin 40 is in its upper retracted position during the return stroke it can pass freely over a record which has previously been transported from the trimming station to the predetermined location L by the push pin 34. Upon return to the starting position when the solenoid 214 is deenergized, the push pin 40 returns to its lower position so that during the next travel of the carriage 114 to the dot-dash line position shown in FIG. 11, the push pin 40 will engage the record at the location L and advance the record to the right along the grooves 36, as viewed in FIG. 11. The stroke of the carriage from the solid to the dot-dash line position of FIG. 11 is sufficient to cause the push pin 40 to advance the trimmed record from the predetermined location L along the curved portion 214 of the guides 38 of the guide means to an extent sufficient to permit the record to continue to travel due to its own weight downwardly along the grooves 36, the record falling freely along the substantially vertical portions of the grooves 36 situated at the downwardly directed right free ends 218 of the guide bars. FIG. 11 shows at the lower left portion of the illustrated guide bar 38 a transverse supporting bar 220 which is fixed to each guide bar to support the latter, this transverse support bar 220 extending between a pair of arms 224 of the stationary supporting frame structure.

Figure 16:
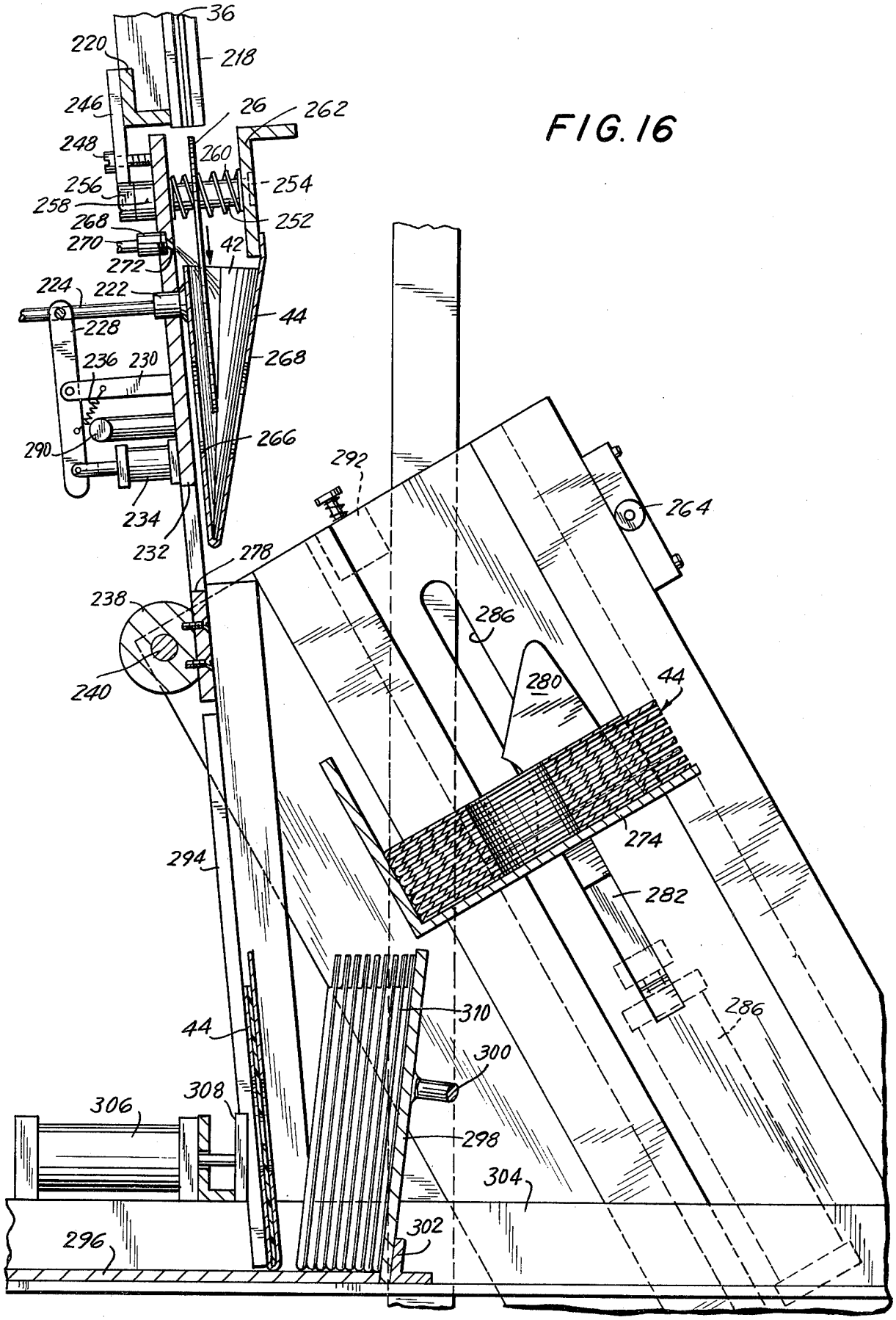
FIG. 16 is a longitudinal partly sectional elevation of the structure of FIG. 15 taken along line 16—16 of FIG. 15 in the direction of the arrows.

As is shown at the upper portion of FIG. 16, an envelope 44 is situated with its upper open end 42 in position to receive the record 26 which continues to fall downwardly beyond the substantially vertical portions 218 of the guide bars 38. The envelope 44 is held in the position shown in FIG. 16 by a holding means which includes a pair of suction cups 222 communicating through pipes 224 with the container 158 which was referred to above in connection with FIG. 19. Through this container the source of suction acting through the tube 162 provides suction at the suction cups 222. As is apparent from FIG. 19, simultaneously with the release of the suction at the labels there is a release of the suction at the suction cups 222 so that an envelope 44 with the record 26 therein falls downwardly from the suction cups simultaneously with the release of the labels at the press station.

Figure 17:
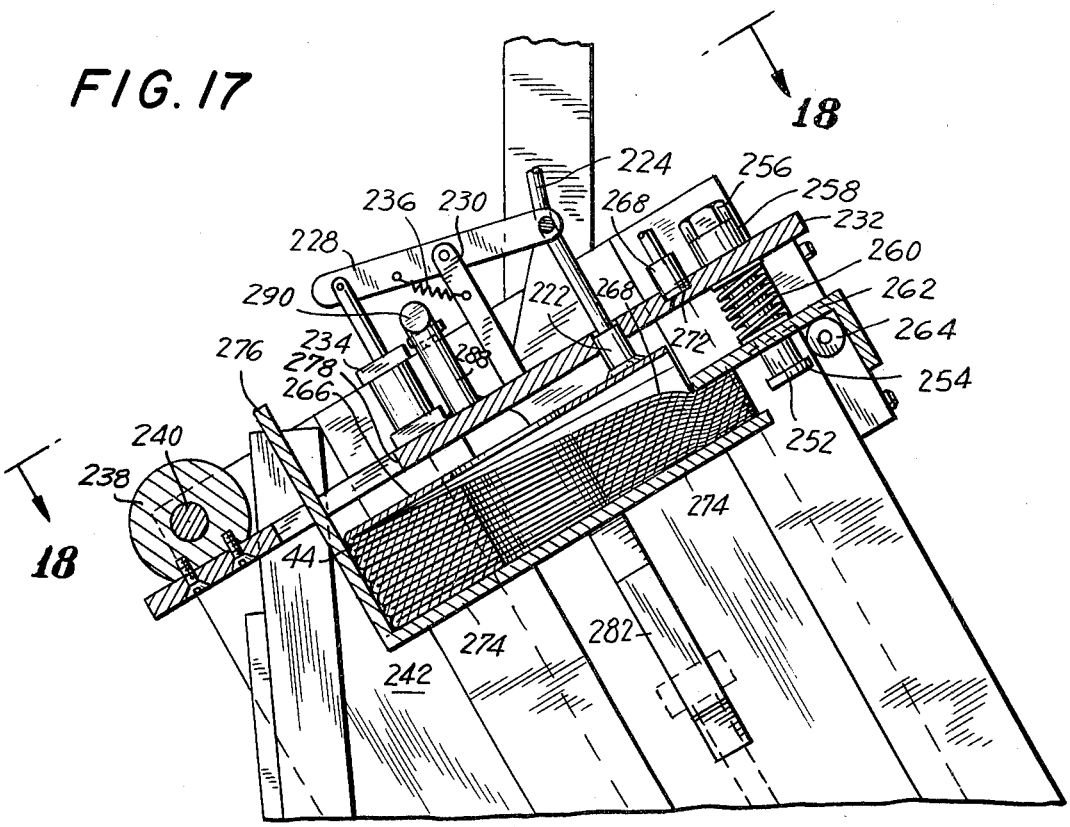
FIG. 17 shows the upper part of the structure of FIG. 16 in a position where and envelope is picked up so as to be swung to the position shown in FIG. 16.
Figure 18:
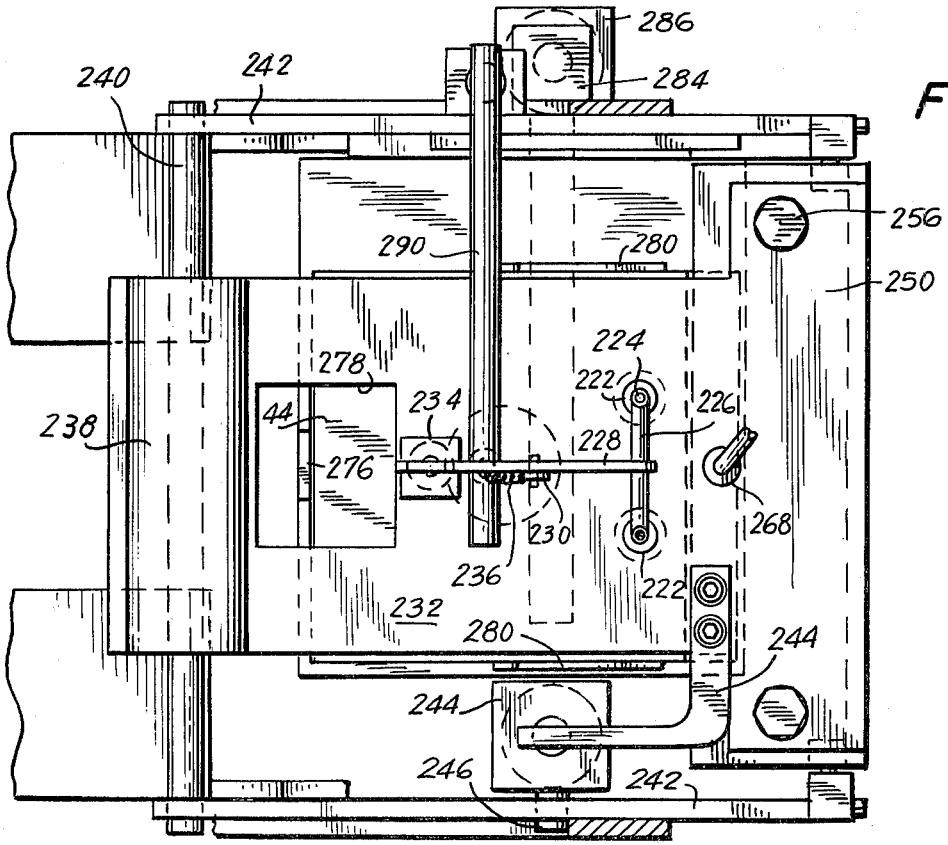
FIG. 18 is a partly sectional plan view of the structure of FIG. 17 taken along line 18—18 of FIG. 17 in the direction of the arrows.

As is shown most clearly in FIGS. 16–18, the pipes 224 which have flexible portions communicating with the container 158 have substantially rigid portions fixed to the suction cups 222 and also fixed to the ends of a transverse bar 226 which in turn is fixed to a swingable lever 228. The lever 228 is supported between its ends for swinging movement by a post 230 which is fixed to the left surface of a swingable plate 232 formed with openings through which the suction cups 222 extend in the manner shown most clearly in FIGS. 16 and 17. The swingable plate 232 carries a solenoid 234, the armature of which is pivoted to the lever 228 so as to swing the latter between the positions shown in FIGS. 16 and 17. A spring 236 is connected between the lever 228 and the post 230 for normally holding the suction cups in the position shown in FIG. 16. When the solenoid 234 is energized the suction cups 222 are shifted to the position shown in FIG. 17.

Figure 15:
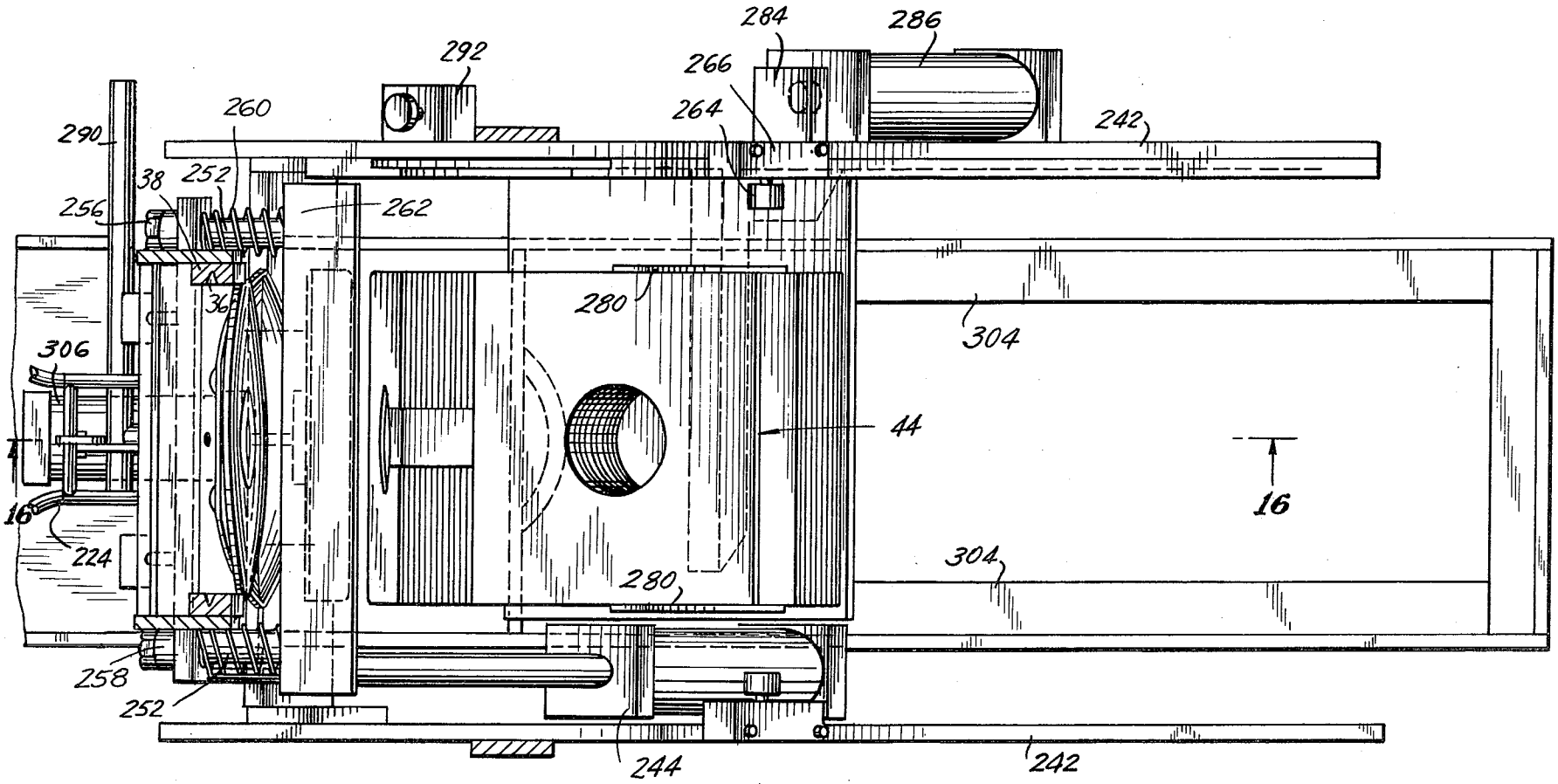

The plate 232 is fixed to a swingable horizontal bar 238 supported for rotary movement on a rod 240 extends across and is carried by the frame structure 242 which is inclined upwardly toward the left, as viewed in FIG. 17. An L-shaped bracket 244 (FIG. 18) is fixed to the rear surface of the swingable plate 232, and this bracket is also pivotally connected to a piston rod of a pneumatic piston-and-cylinder unit 244 which is illustrated in FIG. 15. The frame assembly 242 includes a pair of outer walls, and the unit 244 is situated between these walls next to the left wall 242 which is illustrated in FIG. 15. The lower end of the unit 244 carries a pivot pin 246 extending through an opening in the left wall 242 of FIG. 15, the pivot pin 246 being illustrated in FIG. 18, so that the unit can swing while at the same time expanding and contracting during turning of the plate 232 around the rod 240. The unit 244 is capable of swinging the plate 232 between the upright position shown in FIG. 16 and the lower position shown in FIG. 17. As is indicated at the upper portion of FIG. 16, the frame structure 220 which carries the guide bars 38 at their lower portions 218 also fixedly carries a lug 246 provided with an adjustable stop screw 248. The upward swinging movement of the plate 232 is limited by engaging the stop screw 248, and this screw is adjusted so that the grooves 36 will direct the falling record 26 into the envelope 44 as is apparent from FIG. 16.

As is most clearly shown in FIG. 18, the plate 232 is of a substantially T-shaped configuration and has distant from the rod 240 an elongated portion 250 which is wider than the remainder of the plate 232 and which is the portion of the plate 232 which engages the stop screw 248 shown in FIG. 16. Actually there are a pair of such stop screws carried by a pair of the lugs 246, these stop screws engaging the portion 250 of the plate 232 adjacent the outer ends thereof. The pair of stop screws 248 and the lugs 246 carrying the same are visible in FIG. 4.

Adjacent its outer ends the wider portion 250 of the plate 232 carries a pair of sleeves 252 through which bolts pass, these bolts having head ends 254 larger than the sleeves 252. The ends of the bolts 254 opposite from the head ends extend through openings in the wider portion of the plate 232 and at the side of the wider portion 250 opposite from the sleeves the bolts 252 are threaded with nuts 256 which engage suitable spacers or washers 258, so that in this way the sleeves 252 are fixed in a position illustrated. These sleeves 252 are surrounded by springs 260 and pass through openings of an elongated angle member 262, these openings being suitably countersunk to receive the bolt heads 254 in the manner illustrated at the upper portion of FIG. 16. When the unit 244 is actuated to swing the plate 232 down to the position shown in FIG. 17, the angle member 262 engages a pair of rollers 264 mounted on pins carried by suitable mounting assemblies 266 which are in turn mounted on the frame walls 242. Thus, as is apparent from FIG. 17, when the plate 232 is swung down to the position shown in FIG. 17, the springs 260 will be compressed and the angle member 264 will be prevented from moving together with the sleeves 252 to the extent illustrated in FIG. 17.

As is apparent from FIG. 17, each envelope 44 has an upper wall 266 engaged by the suction cups 222 and a longer lower wall which is engaged by a portion of the angle member 262 at the region where this longer lower wall 268 of each envelope projects beyond the upper wall 266 thereof, as viewed in FIG. 17. Because of the suction which is provided at the suction cups, when the plate 232 is returned to the position shown in FIG. 16, the uppermost envelope of the stack shown in FIG. 17 will return with the plate 232, and the springs 260 can expand when the angle member 262 moves away from the rollers 264 so that the parts will have the position shown in FIG. 16 where the envelopes are maintained open. In addition, a nozzle 268 communicates through a flexible tube 270 with a source of compressed air which discharges from the nozzle 268 through an inclined bore 272 which passes through the plate 232 so that a stream of air is directed into the envelope to assure that the latter remains open.

The stack of envelopes 44 rest on a plate 274 which has an upwardly inclined wall 276 fixed to one edge thereof and engaging the bottom edges of the envelopes 44. Thus, the stack of envelopes 44 will rest on the plate 274 in the manner illustrated in FIG. 16. As is apparent from FIGS. 17 and 18, the wall 276 is in the form of an elongated relatively narrow plate. The plate 232 is formed with a rectangular opening 278 which receives the wall 276 which extends through the opening 278 in the manner shown most clearly in FIG. 17, when the plate 232 is lowered to the envelope-receiving position shown in FIG. 17. Of course in this latter position the solenoid 234 is energized so as to swing the lever 228 to the position shown in FIG. 17, causing the suction cups 222 to press against the wall 266 of the uppermost envelope of the stack while the angle member 262 will maintain the outer end of the longer envelope wall 268 in the manner shown in FIG. 17 so as to assure opening of the envelope, with this opening being further assured by the air issuing from the nozzle 268.

The envelope-carrying plate 274 also carries a pair of upstanding relatively thin plates 280 which have the configuration most clearly apparent from FIG. 16. These parallel thin plates 280 engage the opposed sides of the stack of envelopes 44 so as to precisely position the envelopes on the plate 274. The distance between the plates 280 is somewhat greater than the width of the narrow portion of the plate 232 so that this narrower portion can be situated between the plates 280 directly in engagement with the envelopes as is apparent from FIG. 18. The bottom surface of the envelope-carrying plate 274 is fixed to the top edge of a substantially L-shaped member 282 shown most clearly in FIG. 4. The upper horizontal leg of member 282 extends along the bottom of the plate 274, while the vertical leg thereof has a horizontal extension 284 at its end distant from the horizontal leg which engages the plate 274 and this horizontal extension passes through an elongated slot 286 which guides the member 282 and the plate 274 carried thereby for movement along the slot 286 in an up and down direction. The extension 284 is fixed to the top end of a piston rod of a fluid-pressure unit 286 such as a suitable pneumatic unit. Normally the piston of this unit is retracted and the support 282 as well as the plate 274 are in their lower postion below the elevation illustrated in FIG. 17. The plate 232 carries adjacent the solenoid 234 a support post 288 which in turn is fixed with an elongated horizontally extending rod 290. When the plate 232 is swung down to the postion shown in FIG. 17, a free end of the rod 290 engages a valve 292. This valve is connected in an unillustrated manner to a source of air under pressure and is also connected to the unit 286 in such a way that when the plate 232 is swung down to the position shown in FIG. 17, the rod 290 actuates the valve 292 and transmits air under pressure beneath the piston of the unit 286 so as to forcefully raise the plate 274 up to the position shown in FIG. 17, thus situating the uppermost envelope reliably in engagement with the suction cups 272 as well as in engagement with the angle member 262 in the manner illustrated in FIG. 17. When the plate 232 returns to its upper position shown in FIG. 16, the rod 290 moves upwardly away from the valve 292 so as to release the latter, and air in the unit 286 is vented so that the parts then resume their initial position. Thus at any time additional envelopes can be added to the stack of envelopes 44, and irrespective of the height of the stack it is possible for the uppermost envelope always to be placed forcefully in engagement with the suction cups and the angle member 262 in a manner described above.

As has been indicated above, when the roller 128 swings the lever 146 to the position opening the container 158, the suction to the suction cups is terminated so that an envelope with a record therein can fall from the plate 232. Upon return of the carriage 114 to its starting position shown in solid lines in FIG. 11, the switch 174 is actuated by the projection 132, as described above, and in response to actuation of the switch 174, the unit 244 is actuated to pull the plate 232 down to the position shown in FIG. 17 for receiving an envelope, and this plate is then returned back to the position shown in FIG. 16 so that envelope is situated in readiness to receive a falling record 26 as described above.

As is apparent from FIG. 16 when the plate 232 is in its upper position determined by the stop members 248, it is in the same plane as a pair of coplanar fixed upright plates 294 one of which is shown in FIG. 16. The pair of plates 294 are also visible in FIG. 4. Thus the falling envelope with the record therein will slide downwardly along the plates 294 after falling beyond the upright plate 232 when the vaccuum is released from the suction cups in the manner described above. Of course, at the same time that the unit 244 receives an impulse to swing the plate 232 down to the position shown in FIG. 17, the solenoid 234 is also energized, but when the plate 232 is returned to the position of FIG. 17, the solenoid 234 is unenergized so that the spring 236 acts to swing the lever 228 and return the suction cups to the position shown in FIG. 16. The falling envelope 44 with the record therein falls downwardly along and slidably engages the upright plates 294 until the bottom edge of the envelope engages the horizontal plate 296 which is fixed to an upright plate 298 carrying a suitable handle 300 and fixed to an angle member 302 which is slidable along the lower walls of a pair of parallel angle members 304. The angle members 304 are bridged to the left of the plates 294 by a supporting structure which carries a pneumatic unit 306 which in response to actuation of the switch 174 by element 132 when the carriage 114 returns to its starting position receives a pulse of air advancing the piston of the unit 306 to the right, as viewed in FIG. 16. This piston is fixed at its right end to a pusher plate 308 which passes through the space between the upright members 294 and engages the envelope 44 which has just reached the lower position at the plates 294 shown in FIG. 16 upon release of the suction from the suction cups 222. Thus this last envelope to receive a record becomes situated in front of the pusher member 308 and upon actuation of the unit 306 this last envelope 44 is pushed against the horizontal stack 310 resting against the plate 298 in a manner shown at the lower part of FIG. 16. In this way as each envelope falls onto the plate 296, the unit 306 is actuated to add this envelope with the record therein to the stack 310 so that the stack 310 becomes longer and longer while the plate 298 together with the plate 296 and member 302 are advanced along the rails 304. The plate 274 is shown in FIG. 16 in its lower position from which it is moved upwardly in the manner described above. It will be apparent from FIG. 16 that it is possible for the plate 298 with the stack 310 to pass freely beneath the lowermost edge of the plate 274 where the latter is connected to the upwardly extending plate 276. In this way an exceedingly compact arrangement is provided. The manner in which the horizontal stack is formed is also apparent from the lower right portion of FIG. 3. When a sufficient number of records are situated in the horizontal stack 310, the plate 300 can be pulled forwardly together with the plates 298 and 296 as well as element 302, and the entire stack can be removed while a new plate 296 without any records thereon and connected with another plate 298 and handle 300 as well as handle member 302 can be placed on the rails 304 with the plate 298 initially starting close to the plates 294 so that a new stack can start. The stack 310 of FIG. 16 of course corresponds to the stack 46 shown in FIG. 1.

As is apparent from the above description, an exceedingly simple method and apparatus are provided according to the present invention for achieving a high output with a structure which occupies only a relatively small amount of space. During the pressing and trimming operations a new cake and labels are placed in readiness to be received at the pressing station during the next operating cycle and of course another envelope is situated in readiness to receive the next record which falls from the guide bars 38. During each operating cycle while the carriage 114 moves from the solid to the dotted line position shown in FIG. 11, a previously pressed record is transferred from the press station to the trimming station, a previously trimmed record is transferred from the trimming station to the predetermined location L the record previously situated at the latter location L is advanced along the guide gbars 38 so as to fall into the open envelope, and the flash from the previously trimmed record is transferred to the chute 192 so as to be disposed of. By the time the carriage 114 reaches the dot-dash line position shown in FIG. 11, the cake and labels are situated at the press station and of course the envelope held in the upper position shown in FIG. 16 has received a record. The actuation of the lever 146 at this time in the manner described above releases the labels from the suction devices holding the same at the press station and simultaneously the envelope is released from the suction cups 232, so that the envelope 44 with the record therein falls in the manner shown in FIG. 16 and described above while the arms 58 and 64 return to their starting position leaving a cake and labels at the press station to be operated upon during the next cycle. In this way an extremely simple and highly effective operating cycle is achieved providing an high output of records. In actual practice it has been found that it is possible for a complete cycle as described above to be performed in an interval of 13 seconds so that with the method and apparatus of the invention it is possible to provide an additional record in an envelope every 13 seconds.

What is claimed is:

1. In a method for manufacturing a disc record, the steps of pressing, at a press station, a record from a preliminarily formed cake while simultaneously attaching labels to opposed faces of the record and while maintaining the pressed record in a horizontal attitude, with a flash being formed along the periphery of the pressed record at said press station, then transporting the thus-pressed record from said press station to a trimming station whill still maintaining the record at a horizontal attitude, trimming the flash from the record at said trimming station while still maintaining the record at a horizontal attitude, then transporting the thus-trimmed record away from the trimming station to a predetermined location while maintaining the record in a horizontal attitude, then pushing the record along stationary downwardly curved guides to free the record for falling movement under its own weight while simultaneously guiding the record during its falling movement in a manner changing said horizontal attitude into a substantially upright attitude, so that the record while in said substantially upright attitude falls downwardly along a given path, and holding an envelope with an upper open end in the path of falling movement of the substantially upright record so that the record is received in the envelope.

2. In a method as recited in claim 1 and including the step of dropping the envelope with the record therein to a given elevation lower than the elevation of the envelope when it receives the record while maintaining the envelope and the record therein in an upright attitude, repeating all of the above steps so as to provide in succession a series of envelopes with records respectively situated therein at said elevation lower than the elevation at which each envelope initially receives a falling record, and pushing each envelope with a record therein when reaching said lower elevation along a horizontal path to form a horizontal stack of substantially upright envelopes each having a record therein.

3. In a method as recited in claim 1 and including the step of dropping the record at the trimming station after flash has been trimmed therefrom onto horizontal guides which maintain the record in a horizontal attitude, while maintaining the record at a constant elevation subsequent to trimming of flash therefrom and until the step of dropping the record onto said horizontal guides, and pushing the record along said horizontal guides from the trimming station to said given location.

4. In a method as recited in claim 3 and including the step of pushing the record again from said given location beyond the latter while permitting the record to fall and change its attitude to a substantially upright attitude.

5. In a method as recited in claim 1 and including the steps of holding labels by suction at said press station with a cake therebetween in readiness for pressing of a record and simultaneously holding an envelope by suction in the path of downward falling movement of a record which travels beyond said given location, and simultaneously releasing the suction on the labels at the press station and the suction on the envelope so that an envelope with a record therein starts to fall simultaneously with commencement of pressing operations at the press station.

6. In a method as recited in claim 5 and including the steps of simultaneously pushing a record from said trimming station to said predetermined location and pushing a previously pushed record from said location to be guided for falling movement into the open end of an envelope, and also simultaneously with said pushing steps transporting a record from the press station to the trimming station.

7. In a method as recited in claim 6 and including the steps of preparing a cake and a pair of labels for delivery to the pressing station and situating an envelope in readiness to receive a falling record while pressing and trimming operations are carried out at the press and trimming stations.

8. In an apparatus for manufacturing disc records, pressing means at a press station for pressing a record from a preliminarily formed cake while simultaneously attaching labels to opposed faces of the pressed record and while forming a flash along the periphery of the pressed record, trimming means situated at a trimming station beyond but substantially at the same elevation as said pressing means for trimming flash from a record, holding means situated beyond but at an elevation lower than said trimming means for holding an envelope in a substantially upright attitude with an upper open end in readiness to receive a trimmed record, transporting means for simultaneously transporting a pressed record from said press station to said trimming station, a trimmed record from said trimming station to a given location beyond the latter and a third record previously situated at said location beyond the latter location, said transporting means maintaining the records in a horizontal attitude while they are transported from the press station to the trimming station and from the trimming station to said given location, and stationary guide means extending from the latter location to said holding means for guiding a record transported beyond said location in a manner changing the attitude of the record from a horizontal attitude to a substantially upright attitude while guiding the record in its substantially upright attitude for falling movement into the envelope through the upper open end thereof while the envelope is held by said holding means, said guide means forming an extension of a part of said transporting means which transports a record from said trimming station to said given location, said guide means including elongated stationary bars which are parallel to and spaced from each other and which have directed toward each other grooves for receiving opposed edge regions of a record, said transporting means including a push pin for pushing a circular record at a rear edge region thereof along said grooves and said bars being curved downwardly beyond said location to change the attitude of the record and to permit the latter to fall while in a substantially upright attitude into an envelope held by said holding means.

9. The combination of claim 8 and wherein a pair of ledges form part of said transporting means and are situated beneath opposed edges of a record which falls at the trimming station immediately subsequent to the trimming operations, said ledges positioning a record which has just been trimmed at an elevation to be received at its opposed edge regions in said grooves, and said transporting means including a second push pin initially situated between said press and trimming stations for pushing a record resting on said ledges from the latter into said grooves while said first-mentioned push pin pushes a record previously transported from said trimming station further along said grooves to be guided thereby for falling movement into an envelope.

10. The combination of claim 9 and wherein gripping finger assemblies form part of said transporting means to grip a record at said press station at opposed flash portions of the pressed record, said gripping fingers traveling from the press station to the trimming station to transport a record thereto and said gripping fingers including a portion carrying said second push pin.

11. The combination of claim 10 and wherein a pair of slide rails carry said gripping fingers and form part of said transporting means, pivots for said gripping fingers being fixed with said slide rails, and a bar being connected with said fingers for actuating the latter and for acting through said fingers on said slide rails to shift the latter while said push pins act to transport a pair of records respectively beyond the trimming station and to the path of falling movement into the envelope, a carriage being carried by said slide rails and carrying said first-mentioned push pin as well as an actuating means connected to said bar for actuating the gripping fingers and for transporting said slide rails in response to movement of said carriage, frame means carrying said pressing and trimming means and also carrying a moving means for moving said carriage.

12. The combination of claim 11 and wherein said ledges are swingably carried by said frame means, said trimming means including a lower trimming die and an upper trimming die, the latter being carried by said frame means while a ram means is connected to said lower die for raising the latter to bring about a trimming operation, and means cooperating with said lower die for swinging said ledges away from each other beyond the path of movement of the lower die when the latter approaches said upper trimming die, and said ledges being released for swinging return movement to a location beneath a trimmed record upon lowering of said lower die so that when the trimmed record falls from the upper die it will be received on said ledges.

13. The combination of claim 11 and wherein said carriage carries a means for gripping the trimmed flash and for transporting the latter away from the trimming station simultaneously with movement of the carriage to bring about transporting of a trimmed record away from the trimming station.

14. The combination of claim 11 and wherein a suction means forms part of said holding means for holding an envelope in readiness to receive a falling record, release means connected with said suction means for releasing the suction thereof to release an envelope with a record therein for falling movement from said holding means, and actuating means carried by said carriage for movement therewith, said release means being engaged by said actuating means when said carriage has moved said first-mentioned push pin through a distance sufficient to situate a record in an envelope.

15. The combination of claim 14 and wherein a second suction means cooperates with labels for holding the latter at said press station in readiness to be attached to opposed faces of a pressed record, and said release means also being connected to said second suction means for simultaneously releasing the latter so that the labels are released at said press station simultaneously with release of the suction means of said holding means.

16. The combination of claim 8 and wherein an envelope supply means is situated adjacent said holding means for supplying envelopes thereto, said holding means including a plate and means supporting said plate for swinging movement first downwardly to an envelope situated at said envelope supply means and then upwardly to a position for holding an envelope in readiness to receive a record, means connected to said plate for swinging the latter between a lower position to receive an envelope and an upper position for holding an envelope in readiness to receive a record, and suction means carried by said plate for engaging an envelope at said envelope supply means and for raising the latter envelope with said plate to a position in readiness to receive a record, means being situated adjacent the plate when in its upright position for engaging an envelope and maintaining the upper end thereof open when the plate is in its upright position.

17. The combination of claim 16 and wherein a means is operatively connected with said envelope supply means and with said plate for responding to downward movement of the latter to raise envelopes of said envelope supply means upwardly to position an envelope in engagement with said suction means carried by said plate.

18. The combination of claim 16 and wherein a release means is operatively connected with said holding means for releasing the latter to drop an envelope with a record therein to an elevation below said holding means, means situated beneath said holding means for receiving the dropped envelope while supporting the latter at a lower edge and maintaining the dropped envelope in an upright position, and pushing means situated at the elevation of the dropped envelope for pushing the latter horizontally, so as to provide a horizontal stack of upright envelopes with records therein.

19. The combination of claim 18 and wherein said envelope supply means is situated directly over a horizontal stack of envelopes formed by said pushing means.

* * * * *